US007893335B2

(12) United States Patent
Szczap

(10) Patent No.: US 7,893,335 B2
(45) Date of Patent: Feb. 22, 2011

(54) KEY LEVELER FOR MUSICAL INSTRUMENTS, COMPUTERIZED KEY LEVELING SYSTEM, AND METHODS OF USE

(76) Inventor: Joseph P Szczap, 1428 Duquesne Ave., Naperville, IL (US) 60565

( * ) Notice: Subject to any disclaimer, the term of this patent is extended or adjusted under 35 U.S.C. 154(b) by 193 days.

(21) Appl. No.: 12/006,808

(22) Filed: Jan. 4, 2008

(65) Prior Publication Data

US 2010/0064879 A1 Mar. 18, 2010

(51) Int. Cl.
*G10D 3/00* (2006.01)

(52) U.S. Cl. ..... 84/433

(58) Field of Classification Search ..... 84/423 R, 84/430–435, 437–457
See application file for complete search history.

(56) References Cited

U.S. PATENT DOCUMENTS 7,767,891 B2 * 8/2010 Yamaguchi ..... 84/423 R

* cited by examiner

*Primary Examiner*—Kimberly R Lockett
(74) *Attorney, Agent, or Firm*—George E. Bullwinkel

(57) ABSTRACT

A key leveler and method of use for leveling keys on a musical instrument keyboard. A horizontal guide rail holding a gauge holder and height indicator is leveled over the keyboard. The gauge holder includes a downward-extending push rod for contacting each key. An index cylinder and spring adjustment screw adjust the spring force applied to the push rod. The index cylinder is selectively positionable in park, rest, and depressed positions for each key. The system also includes an electronic height indicator, a laptop computer, and a software program for simultaneously calculating the optimal shimming for each key.

59 Claims, 11 Drawing Sheets

Figure 1:
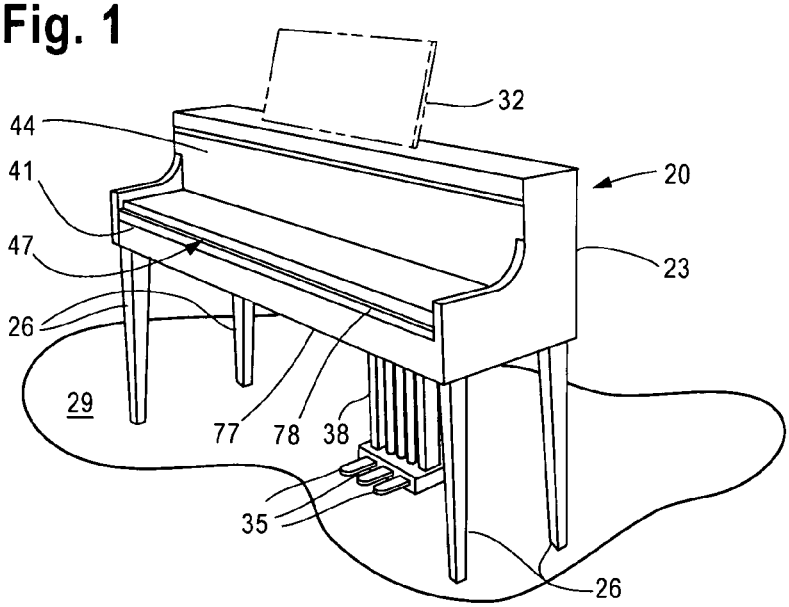

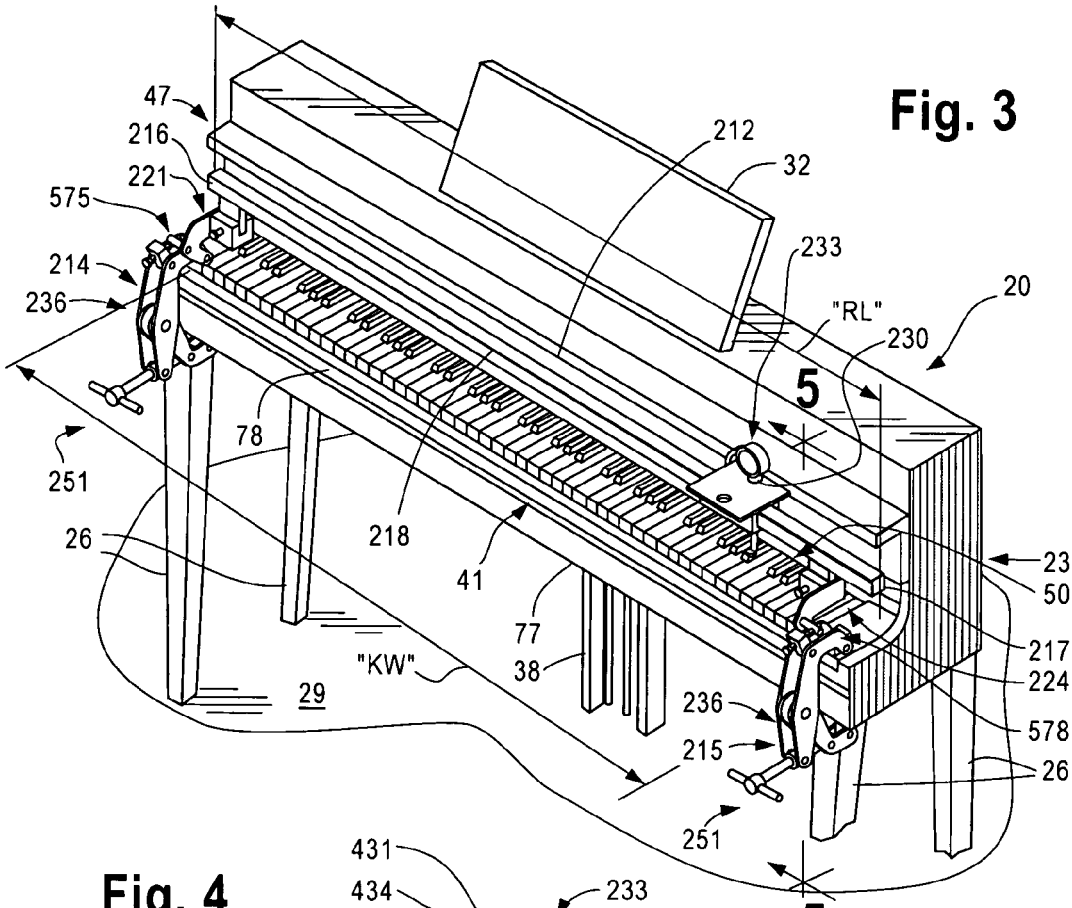
Fig. 3
Fig. 4
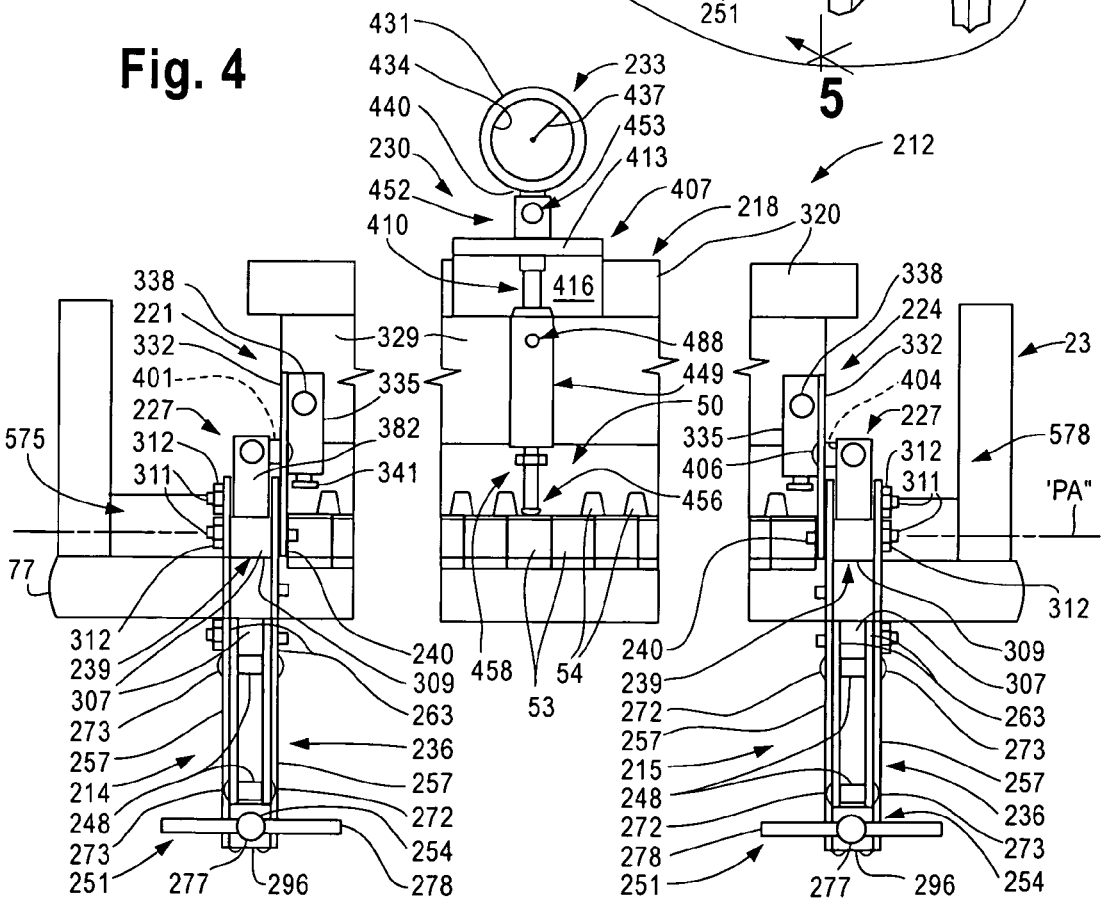

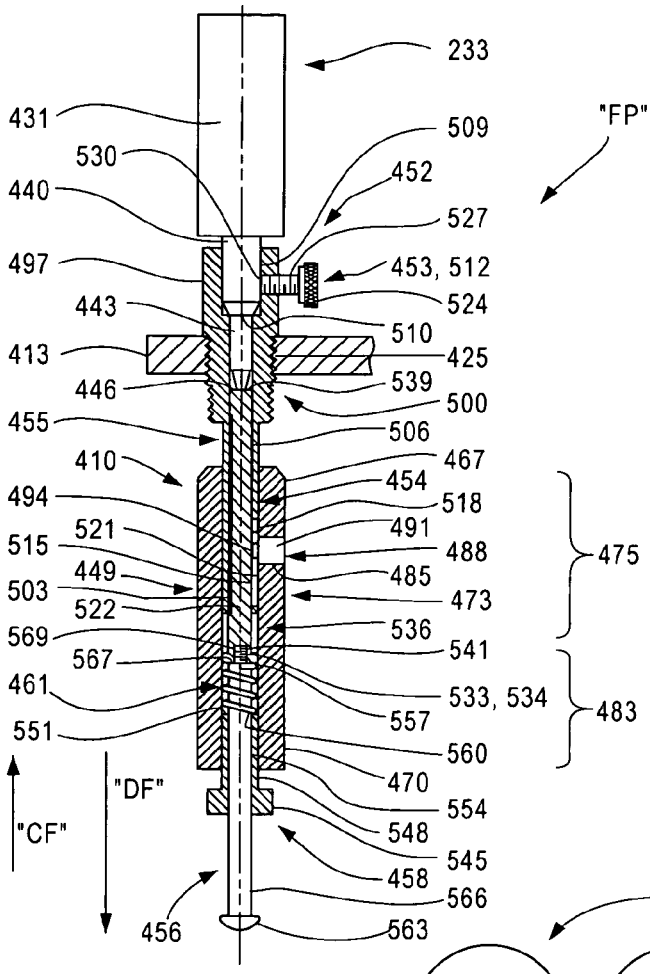
Fig. 7
Fig. 8
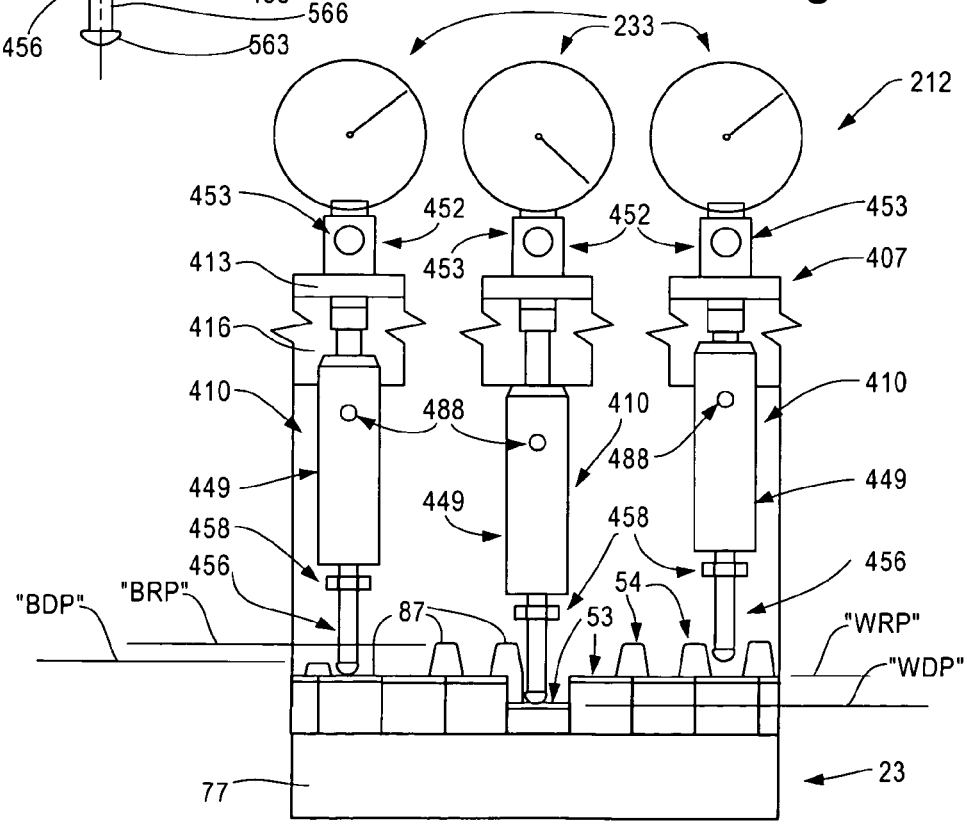

| "KS" | VALUE |
|---|---|
| A | 0.916 |
| B | 1.831 |
| C | 3.662 |
| D | 5.494 |
| E | 1.325 |
| F | 9.156 |
| G | 10.987 |
| H | 12.818 |
| I | 14.650 |
| J | 18.481 |
| K | 18.312 |
| L | 20.143 |
| M | 21.974 |

| "KS" | VALUE |
|---|---|
| N | 20.806 |
| O | 25.637 |
| P | 27.468 |
| Q | 29.299 |
| R | 31.130 |
| S | 32.962 |
| T | 34.793 |
| U | 36.624 |
| V | 38.455 |
| W | 40.286 |
| X | 42.118 |
| Y | 43.949 |
| Z | 45.780 |

Fig. 16

602 683 677

QUICKEY LEVELER - TECHNICIAN REPORT

Prepared by: Date
Tech Company
Tech Name
Tech's Address
Tech's Phone Number

Prepared for:
Customer Name
Customer Address
Piano Mfg
Piano Nickname
Piano Age Approximate

686

698

| White Keys | Measured at Rest | Measured Depressed | Out of Level | Balance Ball Shim | Front Ball Shim |
|---|---|---|---|---|---|
| A0 | | | | | |
| B0 | | | | | |
| C1 | | | | | |
| D1 | | | | | |
| E1 | | | | | |
| F1 | | | | | |
| G1 | | | | | |
| A1 | | | | | |
| B1 | | | | | |
| C2 | | | | | |
| D2 | | | | | |
| E2 | | | | | |
| F2 | | | | | |
| G2 | | | | | |
| A2 | | | | | |
| B2 | | | | | |
| C3 | | | | | |
| D3 | | | | | |
| E3 | | | | | |
| F3 | | | | | |
| G3 | | | | | |
| A3 | | | | | |
| B3 | | | | | |
| C4 (MIDDLE C) | | | | | |
| D4 | | | | | |
| E4 | | | | | |
| F4 | | | | | |
| G4 | | | | | |
| A4 | | | | | |
| B4 | | | | | |
| C5 | | | | | |
| D5 | | | | | |
| E5 | | | | | |
| F5 | | | | | |
| G5 | | | | | |
| A5 | | | | | |
| B5 | | | | | |
| C6 | | | | | |
| D6 | | | | | |
| E6 | | | | | |
| F6 | | | | | |
| G6 | | | | | |
| A6 | | | | | |
| B6 | | | | | |
| C7 | | | | | |
| D7 | | | | | |
| F7 | | | | | |
| G7 | | | | | |
| A7 | | | | | |
| B7 | | | | | |
| C8 | | | | | |

General

Analysis Type: Units:

| Arc Height: | White Keys | Black Keys |
|---|---|---|
| Distance Front Rail Plate to Balance rail Pin | | |
| Distance Balaance Rail Pin to Key Pivot at action | | |
| Amount of Key Dip | | |
| Height above White Keys | | |

Notes:

626

680

602 683

| Black Keys | Measurec at Rest | Measured Depressed | Out of Level | Balance Ball Shim | Front Ball Shim |
|---|---|---|---|---|---|
| A0# | | | | | |
| C1# | | | | | |
| D1# | | | | | |
| F1# | | | | | |
| G1# | | | | | |
| A1# | | | | | |
| C2# | | | | | |
| D2# | | | | | |
| F2# | | | | | |
| G2# | | | | | |
| A2# | | | | | |
| C3# | | | | | |
| D3# | | | | | |
| F3# | | | | | |
| G3# | | | | | |
| A3# | | | | | |
| C4# | | | | | |
| D4# | | | | | |
| F4# | | | | | |
| G4# | | | | | |
| A4# | | | | | |
| C5# | | | | | |
| D5# | | | | | |
| F5# | | | | | |
| G5# | | | | | |
| A5# | | | | | |
| C6# | | | | | |
| D6# | | | | | |
| F6# | | | | | |
| G6# | | | | | |
| A6# | | | | | |
| C7# | | | | | |
| D7# | | | | | |
| F7# | | | | | |
| G7# | | | | | |
| A7# | | | | | |

THE LEVELER COMPANY

KEY LEVELER FOR MUSICAL INSTRUMENTS, COMPUTERIZED KEY LEVELING SYSTEM, AND METHODS OF USE

BACKGROUND OF THE INVENTION

1. Field

The present invention generally relates to key levelers used to level the keys on the keyboards of musical instruments, and more particularly to such key levelers used in the initial assembly, repair, and restoration, and rebuilding of pianos or other piano-like keyboards to aid in leveling the keys.

2. State of the Art

Referring to FIG. 1, therein is shown a keyed musical instrument in the form of a conventional upright piano 20 that includes a cabinet 23 supported by a plurality of downwardly dependent legs 26 on a ground surface 29, a music stand 32, and a plurality of pedals 35 supported just above the ground surface 29 by a downwardly dependent pedal support 38. A keyboard structure 41 is enclosed by the cabinet 23 and accessible through a hinged door 44 for servicing. A keyboard cover 47 is hinged to the cabinet 23 to cover the keyboard structure 41 during periods of non-use.

Figure 2:
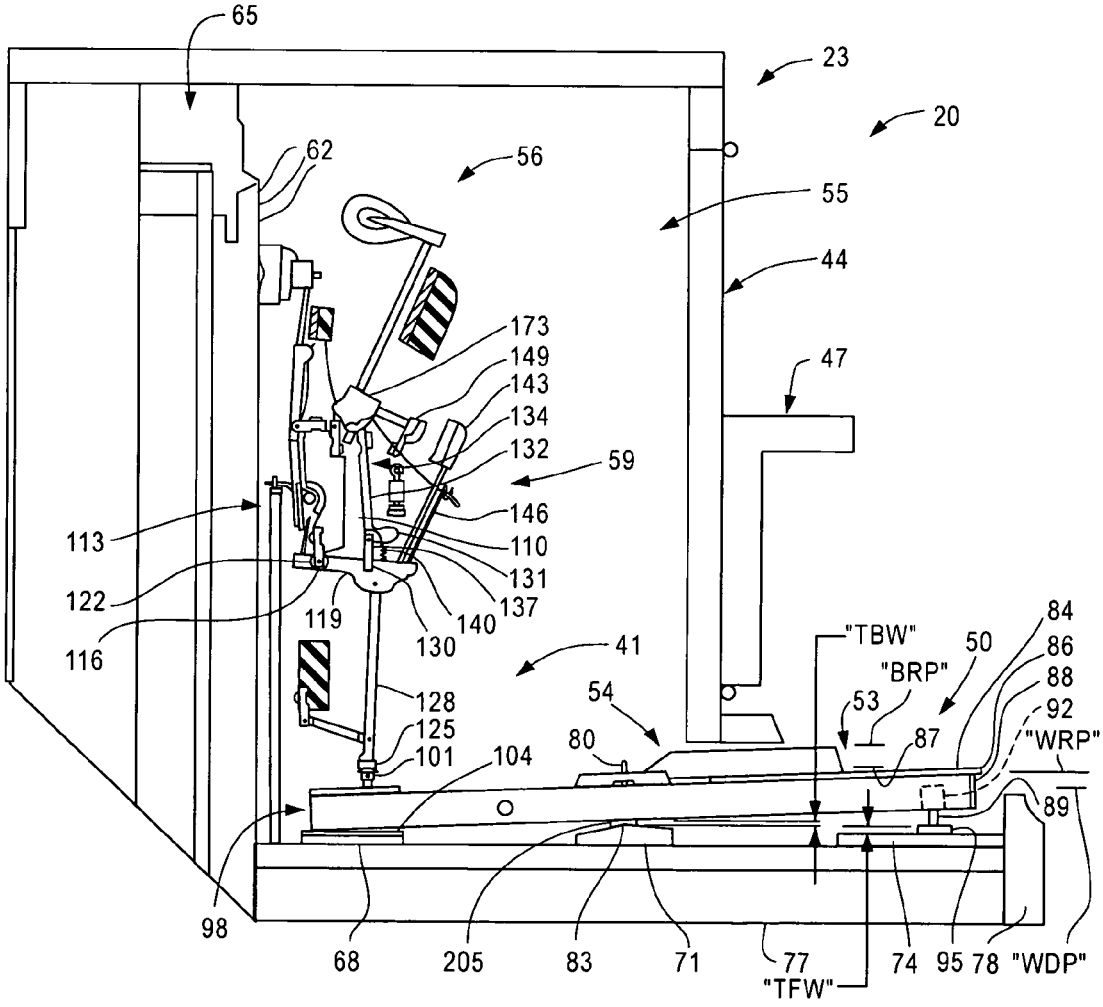

Referring to FIG. 2, the keyboard structure 41 includes a keyboard 50 containing a standard number of white keys 53 and black keys 54, an action 55 that includes a hammer assembly 56 and an action mechanism 59 for rotating the hammer assembly 56, and a plurality of strings 62 retained in a vertical orientation under tension by a string support structure 65 affixed to the cabinet 23.

The keyboard 50 includes the keys 53 and 54 supported on a back rail 68, a balance rail 71, and a front rail 74 mounted to a key bed 77 all of which extend a width "KW" of the keyboard 50. A key stop 78 extends upwardly from the key bed 77. The keys 53 and 54 are each supported by a balance rail pin 80 attached to the balance rail 71 with a flexible balance rail washer 83 so as to freely pivot thereon. A thickness "TBW" of the balance rail washers 83 determines how high each key 53 and 54 is while in an non-depressed, rest position.

Referring specifically to the white keys 53 (the black keys 54 are similarly constructed and supported), they include respective front ends 84 with top panels 86 affixed thereto each having a top surface 87, and a face panel 88 affixed thereto. The front ends 84 of the white keys 53 are laterally retained by respective front rail pins 89 that extend upwardly from the front rail 74 into respective slots 92 of the white keys 53. Respective flexible front rail washers 95 slip over the front rail pins 89 under the front ends 84 of the white keys 53. A thickness "TFW" of the front rail washers 95 determines how far the front end 84 of each white key 53 may be depressed to a depressed position while playing. The white keys 53 each include a rear end 98 with an upwardly dependent capstan screw 101. The rear end 98 engages a flexible back rail cloth 104 affixed to the back rail 68 when the white key 53 is in the rest position. As the front end 84 of each white key 53 is depressed, it rotates about the balance rail 71 with balance rail washer 83 such that the front end 84 contacts the front rail washer 95.

The action mechanism 59 includes a plurality of action brackets (not shown) disposed along a main action rail 110 affixed to the cabinet 23 extending along the width "KW" of the keyboard 50. A plurality of action mechanisms 113 are disposed between the action brackets. The action mechanisms 113 include respective whippen flanges 116 that are connected to the main action rail 110 that correspond to respective of the white keys 53. Respective whippens 119 are rotatably supported by the whippen flanges 116 using respective pivot pins 122. Sticker cloths 125 are affixed to stickers 128 that are rotatably connected to the whippens 119 using respective pivot pins 129 extend downwardly from the whippens 119 to contact the capstan screws 101. Respective jack flanges 130 are affixed to the whippens 119 that rotatably support respective small and large jack portions 131 and 132 of respective L-shaped jacks 134 using pivot pins 137. Respective jack springs 140 are arranged on the whippens 119 that bias the jacks 134 in a counterclockwise rotational direction. Respective back checks 143 are interconnected with respective bridle wires 146 disposed in front of the whippens 119 to elastically receive respective catchers 149 when moved upon depression of respective of the white keys 53. Pairs of the bridle wires 146 and the catchers 149 are interconnected using a bridle strap 152 so as to lock restoration movements of the hammer assembly 56 with the whippens 119. As the whippens 119 are rotated upwardly, the large jack portions 132 of the jacks 134 come into contact the small jack portions 131.

Respective hammer butts 173 are rotatably supported by respective butt flanges 176 connected to the main action rail 110 using respective center pins 179. The hammer assemblies 56 are connected to the hammer butts 173. The catchers 149 are attached to the hammer butts 173 using respective catcher shanks 185. The hammer butts 173 are biased in a counterclockwise rotational direction using respective hammer butt springs 188. The hammer assemblies 56 contact respective hammer butt pads 191 affixed to hammer rails 194.

The hammer assembly 56 includes a hammer shank 200 and a hammer 203 connected to a tip end 204 of the hammer shank 200. The hammers 203 that correspond to the keys 53 and 54 gradually increase in weight in from higher pitched to lower pitched keys 53 and 54.

In the upright piano 20, three of the strings 62 are arranged for each of the keys 53 and 54 belonging to each of a high-pitch register and a middle-pitch register. One or two strings 62 are arranged for each of the keys 53 and 54 belonging to a low pitch register. The strings 62 are gradually increased in thickness from higher pitch to lower pitch strings 62 so that frequencies are gradually reduced. Likewise, the strings 62 increase in length in a pitch-descending order from higher pitches to lower pitches.

When a piano player depresses one of the white keys 53, the capstan screw 101 that extends from the rear end 98 thereof moves upwardly to rotate the corresponding whippen 119 in the counterclockwise direction. The large jack portion 132 of the jack 134 pushes up the hammer butt 173 to rotate the hammer assembly 56 in the clockwise direction such that the hammer 203 contacts the strings 62. After striking the strings 62, the hammer assembly 56 rebounds and rotates in the clockwise direction. The catcher 149 connected to the hammer butt 173 through the catcher shank 185 moves rightwards and contacts the back check 143 to temporarily stop the hammer assembly 56. The jack 134 then moves downwardly and is interlocked with the restoration movement of the whippen 119 which moves downwardly, being interlocked with the restoration movement of the white key 53. The large jack portion 132 moves below the hammer butt 173 ready for a next key depression.

Manufacturing variations in all parts of the keyboard 50, repeated use, humidity, and other factors require that the balance and front rail washers 83 and 95 be of varying thicknesses "TBW" and "TFW", or that shims 205 made of cardboard, paper, or other suitable shimming materials be used to define the rest and depressed positions of each key 53 and 54. The individual rest and depressed positions of the keys 53 and 54 affect the feel of the keyboard 50 to piano players and the sound produced by the piano 20. Therefore, it is important that the top surfaces 87 of each white key 53 are in a common rest plane "WRP" when in the rest position and in a common depressed plane "WDP" when depressed. Likewise, it is important that top surfaces 207 of each black key 54 be in a common rest plane "BRP" when in the rest position and in a common depressed plane "BDP" when depressed.

The process of a piano technician assuring that the top surfaces 87 of the white keys 53 are in the same rest and depressed planes "WRP" and "WDP", and the top surfaces 207 of the black keys 54 are in the same rest and depressed planes "BRP" and "BDP" is known as leveling the keys 53 and 54. The process of leveling the keys 53 and 54 refers to adjusting the thickness of the balance and front rail washers 83 and 95, and the shims 205 under the keys 53 and 54.

Figures 10, 11:
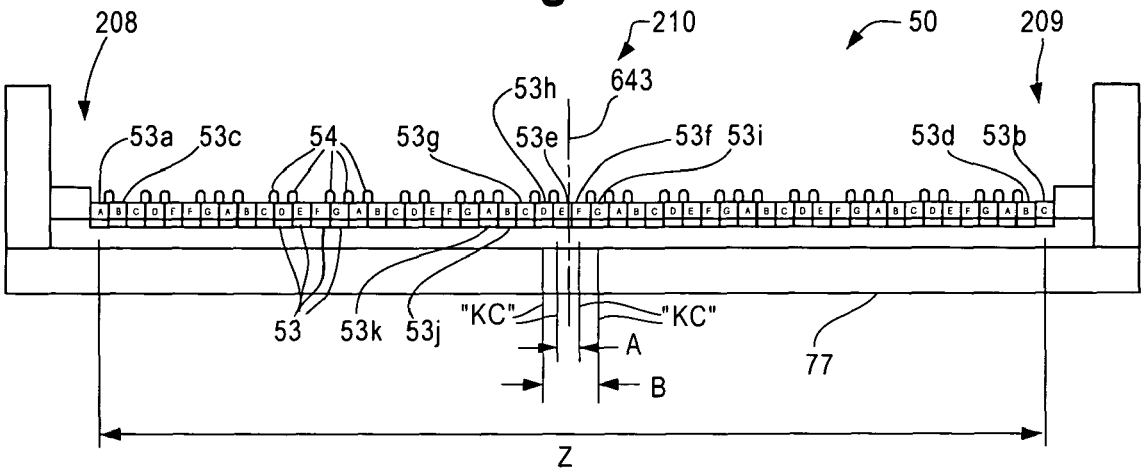

Referring to FIGS. 1, 2, and 10, a conventional leveling process is conducted as follows. The white keys 53 are leveled first. Two outermost white keys 53*a* and 53*b* respectively disposed on extreme left and right ends 208 and 209 of the keyboard 50 are fixed in a position and not allowed to be depressed using retaining washers (not shown) placed on the front rail pins 89. An adjustment bar (not shown) is placed on top of the white keys 53*a* and 53*b* spanning over a remainder of the white keys 53. A bottom surface of the adjustment bar is planar or may bow slightly upwardly in a middle portion of the adjustment bar. Bowing is desirable since the keys 53 and 54 in a middle portion 210 of the keyboard 50 produce the most commonly used musical notes. Thus, they are used more often causing their balance and front rail washers 83 and 95 to wear more quickly. The bow compensates for this wear at the time of leveling the keys 53 and 54 so less frequent key leveling is required.

Once the adjustment bar is placed onto the white keys 53*a* and 53*b*, the technician manually measures or "eyeballs" how far the top surface 87 of each white key 53 is above or below the bottom surface of the adjustment bar. The white keys 53 that require leveling are individually removed from the key bed 77. The technician judges what amount of shimming is needed to be added or removed and whether additional balance rail washers 83 and/or shims 205 of specific thicknesses are needed to bring the top surface 87 of the white key 53 to the rest plane "WRP". The balance rail washer 83 may need to be removed from the balance rail pin 80. Removal of the balance rail washer 83 is complicated by lack of visibility and its small size. A special tool (not shown) is needed to aid in its removal. The technician may likewise place additional balance rail washers 83 and shims 205 onto the balance rail pin 80. The technician then returns the white key 53 to the key bed 77. The adjustment bar is again placed across the white keys 53*a* and 53*b* and the process is repeated for that white key 53 to verify that it is properly leveled. If not, the process is repeated for that white key 53 until the proper rest position is achieved. The process is repeated for each white key 53.

When all of the white keys 53 are leveled with respect to the rest plane "WRP", leveling them with respect to the depressed plane "WDP" begins. A dip tool (not shown) is used for the technician to gauge the depth each white key 53 travels downwardly from the rest position to the depressed position in which the front end 84 contacts the front rail washer 95 on the front rail pin 89. The white keys 53 that require leveling are individually removed from the key bed 77 and the front rail washer 95 is removed from the front rail pin 89. The technician judges what amount of shimming is needed to be added or removed and whether an additional front rail washers 95 and/or shims 205 of specific thicknesses are needed to bring the top surface 87 of the white key 53 to the depressed plane "WDP". The technician places the required additional front rail washers 95 and shims 205 onto the front rail pin 89 and returns the white key 53 to the key bed 77. The adjustment bar is then placed across the white keys 53*a* and 53*b* and the process is repeated for that white key 53 to verify that it is properly leveled. If not, the process is repeated for that white key 53 until the proper depressed position is achieved. The process is repeated for each white key 53.

When all of the white keys 53 are leveled with respect to the rest and depressed planes "WRP" and "WDP", the black keys 54 are leveled. Once again, the black keys 54 are first leveled with respect to the rest plane "BRP". The adjustment bar is used, but the top surfaces 207 of the black keys 54 typically are about one-half inch higher than the top surfaces 87 of the white keys 53. Therefore, a tool (not shown) is used that straddles the white keys 53*a* and 53*b* for the technician to gauge whether or not the top surfaces 207 of the black keys 54 are in the rest plane "BRP". The black keys 54 that require leveling are individually removed from the key bed 77 and adjusted as explained for the white keys 53.

When all of the black keys 54 are leveled with respect to the rest plane "BRP", leveling them with respect to the depressed plane "BDP" begins. The dip tool is used for the technician to gauge the depth each black key 54 travels downwardly from the rest position to the depressed position. The black keys 54 that require leveling are individually removed from the key bed 77 and adjusted as explained for the white keys 53. Once all of the black keys 54 have been leveled, the white keys 53*a* and 53*b* are freed up by removing the retaining washers.

The adjustment bar and process for leveling the keys 53 and 54 has several serious shortcomings. Firstly, it is very tedious and time consuming with the ultimate result depending on the technician's skill level and patience. The process requires repeatedly: 1) placing the adjustment bar across the keys 53 and 54; 2) estimating the error; 3) estimating the proper balance rail washers 83, front rail washer 95, and shims 205; 4) removal of the keys 53 or 54; 5) making the appropriate adjustments; and 6) reattaching the key 53 or 54 for rechecking. The process is repeated as needed for each key 53 and key 54 before moving to the next.

Secondly, the process is prone to inaccuracy due to the fact that the technician needs to estimate washer and shim requirements. This is an angular relationship in the case of the balance rail 71 and the balance rail washer 83 relative to the top surfaces 87 and 207 of the white and black keys 53 and 54. Thus, the initial shimming estimate requires further mathematical manipulation by the technician to compensate for this.

Thirdly, the process is prone to over-adjustment by the technician. If the white keys 53*a* and 53*b* are already set too high or too low at the beginning of the process, all of the keys 53 and 54 will be adjusted according to them resulting in unnecessary over-adjustment. Such over-adjusting can result in problems with operation of the keys 53 and 54. At times, this requires the technician to horizontally reposition and re-level one or more problem keys 53 and 54.

There is a need for a key leveler and method of use that solves the problems encountered using the adjustment bar and process for leveling the keys by: 1) being easy and quick to use; 2) having consistent results that are not so dependent on the technician's skill level and patience; 3) not being an iterative process in which adjustments to one key affect other keys which must be redone; 4) being accurate by telling the technician exactly what the washer and shim requirements are and without requiring any calculations; and 5) not being prone to over-adjustment of the keys by the technician.

SUMMARY OF THE INVENTION

The present invention is a key leveler for leveling keys on keyboards of musical instruments, a computerized key leveling system that utilizes the key leveler, a method of leveling keys, and a method of determining key adjustments for leveling keys.

The key leveler includes a guide rail of sufficient length to extend over all of the keys on the keyboard. A mounting device is adapted to connect to the musical instrument to support the guide rail horizontally disposed above the keyboard. A height indicator indicates relative heights using a stylus slidably disposed through a mounting stem that terminates at a measuring tip. A gauge holder assembly is movably disposed along the guide rail to which the height indicator mounts with the stylus disposed in a vertically downward orientation to operably engage individual keys. The height indicator indicates relative key heights by manually positioning the stylus over individual keys by moving the gauge holder assembly along the guide rail based on movement of the tip of the stylus to determine necessary key adjustments.

In a preferred key leveler, the mounting device comprises a pair of mounting clamps that support opposite ends of the guide rail that are adjustable to grip musical instruments with various vertical gripping distances. The gauge holder assembly includes a bearing block slidably connected to the guide rail to which a tubular gauge holder mounts adapted to retain the height indicator. The gauge holder is comprised of a top section, a middle section that is externally threaded to matingly engage a threaded hole of the bearing block, and a bottom section. The gauge holder has respective threaded down and unthreaded positions for measuring the rest and depressed positions of white and black keys. A longitudinal bore extends through the gauge holder that slidably receives the mounting stem of the height indicator at the top section and that slidably receives the stylus at the middle section. A threaded thumbscrew bore extends transversely into the top section to the longitudinal bore. A thumbscrew has a gripping knob and a dependent threaded shaft that is matingly received in the thumbscrew bore. The shaft has a locking tip that bears against the mounting stem to retain the height indicator to the gauge holder support. A push rod closely slidably fits within the longitudinal bore extending downwardly past the gauge holder support. The push rod has a top end surface that engages the tip of the measuring stylus and a convex bottom end surface that contacts the keys of the musical instrument. The push rod is upwardly spring-biased against the stylus of the height indicator to provide a compensating force that neutralizes a downward force exerted by the stylus and weight of the inner rod to make contact with the keys without sufficient force to actuate the keys. The tip of the stylus is moved by the push rod to determine necessary key adjustments.

The gauge holder preferably includes an index cylinder through which a longitudinal bore extends split by a bushing affixed therein into an upper portion in which the bottom section of the gauge holder support is slidably disposed and a lower portion. A threaded set screw bore extends inwardly to the longitudinal bore that threadably receives a tipped set screw. The push rod then includes a head that closely slidably fits within the lower portion of the longitudinal bore that acts as an upper stop for the push rod. A shaft is upwardly dependent from the head that closely slidably extends through the bushing into the gauge holder support. The bottom section of the gauge holder support then has a longitudinal slot intersected by respective park, rest, and depressed position slots. The slots extend in a radial direction partly around the bottom section. A tip of the set screw is slidably disposable within the slots to allow positioning the index cylinder in respective park, rest, and depressed positions. In the park position, the bottom end surface of the push rod is at a proper height to clear of the keys of the musical instrument. In the rest and depressed positions, the bottom end surface of the push rod is at respective proper heights for measuring heights of the keys in respective rest and depressed positions.

Each mounting clamp preferably includes a pair of long and short arms respectively made of pairs of long and short arm plates each of L-shape held in a spaced relationship. The arm plates have respective horizontal and vertical legs joined at respective elbows and terminate at respective front and rear ends. The arms are pivotally interconnected midway along the vertical leg of the long arm and at the rear end of the short arm. A mounting handle comprised of a gripping handle affixed to a proximal end of a threaded shaft threadably engages and extends through a pivot block pivotally connected to the front end of the long arm. A distal end of the threaded shaft is pivotally connected to the elbow of the short arm. Rotating the mounting handle in opposite rotational directions causes the rear ends of the arms to move together to grip and move apart to release the musical instrument. The mounting clamps are part of respective mounting clamp assemblies each of which includes a pair of mounting pads pivotally connected to the front ends of the arms adapted to engage and grip the musical instrument.

Each mounting clamp assembly preferably includes an L-shaped clamp brace having respective horizontal and vertical arms. The clamp brace is adapted to be disposed between endmost of the keys engaging a key stop of the musical instrument to horizontally and vertically align and prevent slippage of the mounting clamps.

The mounting clamps are preferably part of respective rail mounting assemblies each of which includes a swing arm and a pair of adjustable length draw devices. Each swing arm includes a swing plate having respective lower, rear, front, and middle sections. The lower sections are each pivotally connected to the rear end of the long arm of one mounting clamp. The guide rail is mountable to the rear sections to which the guide rail is mountable and a front section disposed above the lower section interconnected by a middle section. A rail block is affixed to the rear sections to which the guide rail mounts. Each draw device has opposite ends respectively pivotally connected to the elbow of one of the long arms and to the front section of one of the swing arms. Adjusting lengths of the draw devices pivots the swing arms about a pivot axis through the rear ends of the long arms so the guide rail is positionable at a right angle to the keys of the musical instrument.

The guide rail is preferably of substantially constant cross-section comprising a rectangular body and a downwardly dependent mounting leg supported by the mounting device. The bearing block is then preferably of substantially constant cross-section comprising a horizontally disposed top plate and a pair of integral retaining legs of L-shape. The retaining legs define an opened-bottom rail receiving channel that closely receives the guide rail. The top plate has respective forward and rearward extensions that extend past the retaining legs with respective threaded front and rear holes. The front and rear holes threadably engage the middle section of the gauge holder in respective front and rear positions to respectively check white and black keys of the musical instrument. Each rail block then preferably has an upwardly open, vertical rail slot adapted to slidably receive the guide rail. A pair of threaded adjustment screw bores respectively extend horizontally and vertically into the rail block to the rail slot each of which threadably receives a headed adjustment screw.

The adjustment screws are respectively used to vertically position the guide rail and to lock the guide rail to the rail block in a desired vertical position.

The push rod preferably comprises an inner rod having the top end surface and a bottom end surface, and a coaxial extension tip. The extension tip is comprised of a rounded head having the bottom end surface and an upwardly dependent rod that is slidably received within the longitudinal bore of the index cylinder. The extension tip has a top end surface that engages the bottom end surface of the inner rod. The inner rod and the extension tip are retained together by an externally threaded stud that extends longitudinally from the end surface of one of the inner rod and the extension tip. The stud is threadably received in a threaded bore of another of the inner rod and the extension tip.

The gauge holder preferably includes a compression spring vertically disposed about the inner rod within the longitudinal bore of the index cylinder below the bushing. The spring is adapted to provide the compensating force to the inner rod. A spring adjustment screw that has a longitudinal bore through which the push rod slidably coaxially extends. The spring adjustment screw is externally threaded to engage a mating internally threaded section of the longitudinal bore of the index cylinder. The spring adjustment screws adjustably bears against the spring to allow the compensating force to be adjusted.

The computerized key leveling system includes the key leveler of the type described with an electronic height indicator that indicates the relative heights as electronic output signals indicative of the relative key heights. A computer includes a case that contains a microprocessor and related electronics adapted to receive the output signals from the key leveler, a display device, and a keyboard that includes a plurality of keys to allow manual entry of user-defined input parameters and commands. A software program runs on the computer adapted to simultaneously calculate optimal shimming for all of the keys to level the keyboard based on the input parameters and the output signals. The software produces at least one screen on the display device for viewing output data including the optimal shimming.

The method of leveling keys includes the steps of: A) providing a musical instrument having a plurality of keys on a keyboard; B) providing a key leveler that includes; 1) a guide rail of sufficient length to extend over all of the keys on the keyboard; 2) a mounting device adapted to connect to the musical instrument to support said guide rail horizontally disposed above the keyboard; 3) a height indicator that indicates relative heights using a stylus slidably disposed through a mounting stem that terminates at a measuring tip; and 4) a gauge holder assembly movably disposed along the guide rail to which the height indicator mounts with the stylus disposed in a vertically downward orientation to operably engage individual keys; and wherein the height indicator indicates relative key heights based on movement of the tip of the stylus; C) mounting the key leveler to the musical instrument using the mounting device such that the stylus operably contacts the keys; D) taking readings of relative key heights in rest positions from the height indicator by positioning the stylus over individual keys by moving the gauge holder assembly along the guide rail; E) determining necessary key adjustments for the keys in the rest positions based on the relative key heights; F) leveling the keyboard by adjusting rest position heights of at least some of the keys based on the necessary key adjustments; and G) dismounting the key leveler from the musical instrument by releasing the mounting device.

In a preferred method, the musical instrument provided has a plurality of black keys of elevated height interspersed between a plurality of white keys. The height indicator is initially disposed in a first position for measuring one of the white keys and the black keys. The keys are individually placed in a depressed position and additional readings are taken of relative key heights. The necessary key adjustments for the one of the white keys and the black keys are determined with reference to a middle C key of the keyboard in the rest and depressed positions. The height indicator is repositioned to a second position on the gauge holder assembly. The steps of positioning the stylus, taking the readings, and determining the necessary key adjustments for another of the white keys and the black keys are repeated. Leveling of the keyboard is done by adjusting the rest and depressed position heights of the white keys then the black keys.

The method of determining key adjustments for leveling keys comprises the steps of: A) providing a key leveling software program run on a computer; B) entering dimensional data common to the keys that relate to the musical instrument's action into the computer accessible by the software program including: 1) theoretical key depression for the keys; 2) distance between front rail pins and balance rail pins for the keys; and 3) distance between balance rail pin and action arm for the keys; C) entering desired key position information into the computer accessible by the software program of: 1) a desired key arc plane to compensate for more usage of center keys chosen from the group consisting of a straight plane, an arced plane, and an optimized plane; and 2) percent of keys acceptable to lower; D) entering measured key height data into the computer accessible by the software program; and E) the software program uses the dimensional data of the keys and the desired key position information to: 1) calculate a theoretical height of the keys in the rest and depressed positions based on the desired key arc plane; 2) comparing to the measured key height data to produce a differential data set; 3) manipulating the differential data set, and the desired key arc plane for the optimized plane, based on the entered value of percent of keys acceptable to lower and a vertical misalignment routine to produce an optimized key position data set of least amounts of key adjustments at the balance and front rails; 4) using the optimized key position data set and the dimensional data to calculate a shim data set of how much shimming needs to be changed under each key at the balance and front rails to level the keys; and 5) outputting the shim data for each key for a technician to level all of the keys in the rest and depressed positions, and an optimal arc height for the optimized plane.

A preferred method is for determining key adjustments for leveling a plurality of black keys of elevated height interspersed between a plurality of white keys. The method includes a step of entering initial information into the computer accessible by the software program for reporting and calculation purposes. The initial information is chosen from the group consisting of: 1) customer name; 2) customer address; 3) piano manufacturer; 4) piano age; 5) piano nickname; 6) today's date; 7) technician's name; 8) technician's company name; 9) technician's address; 10) technician's telephone number; 11) units of measure in inches or millimeters. The dimensional data entered is common to the white and black keys. The key position information entered is for the white and black keys and includes a theoretical additional height of the black keys above the white keys. The measured key height data is entered for the white and black keys. The software program uses the dimensional data of the white and black keys and the desired key position information to calculate the theoretical height of the white and black keys in the rest and depressed positions. The theoretical height of each black key is calculated by averaging the theoretical height of the white keys immediately on each side thereof and adding the theoretical additional height. The software program allows running of what-if scenarios based on different desired arc heights of the theoretical arc to see effects of such adjustment in the results. The optimized plane is determined using a hierarchy of item importance of: 1) a least amount of disruption to the keys; 2) raising rather than lowering the keys; 3) manufacturing tolerances and angular misalignment where one edge of a key is higher than another; and 4) extreme data points are negated since these keys skew the raw data.

THE DRAWINGS

Figure 5:
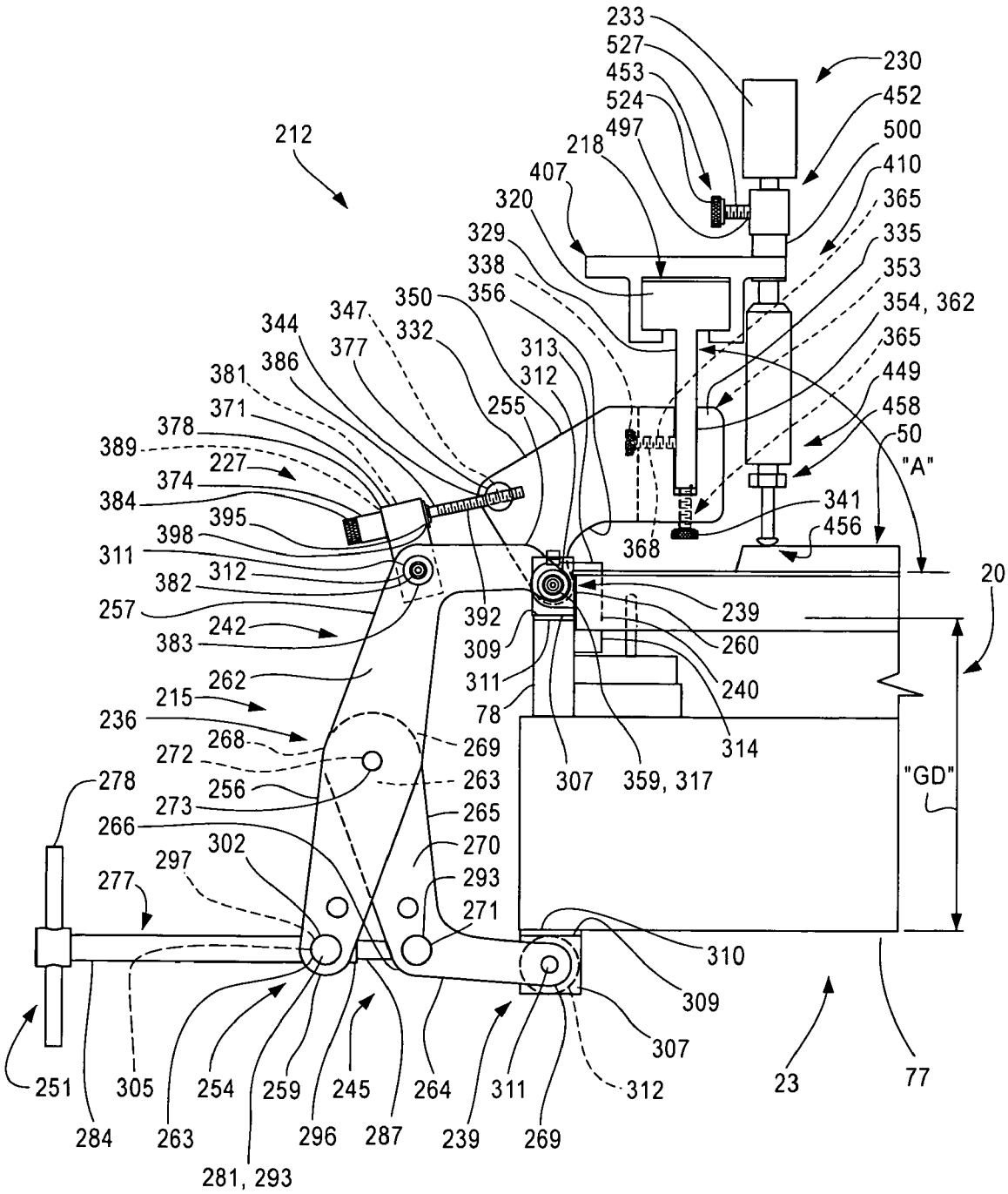
Figure 6:
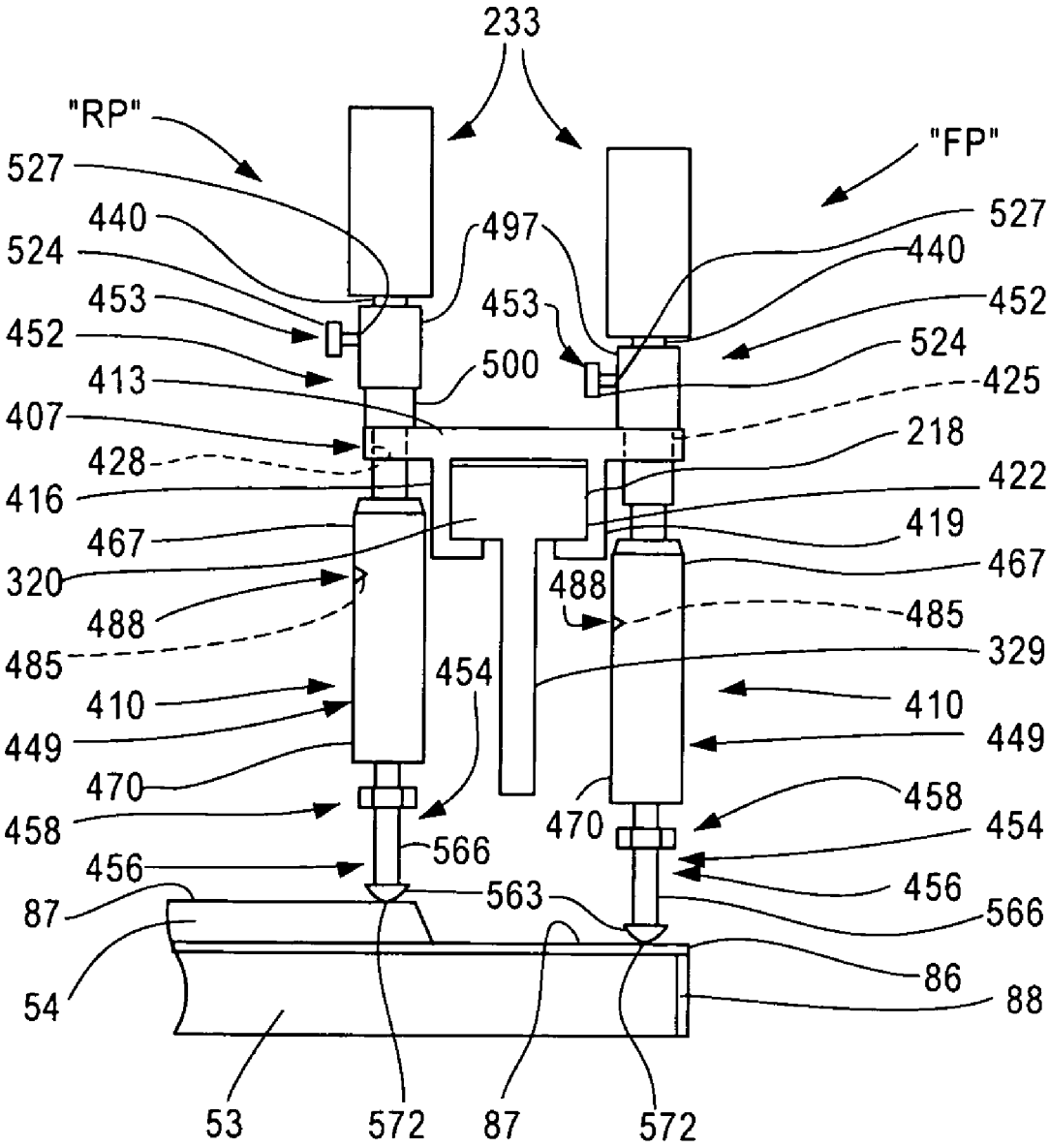
Figure 9:
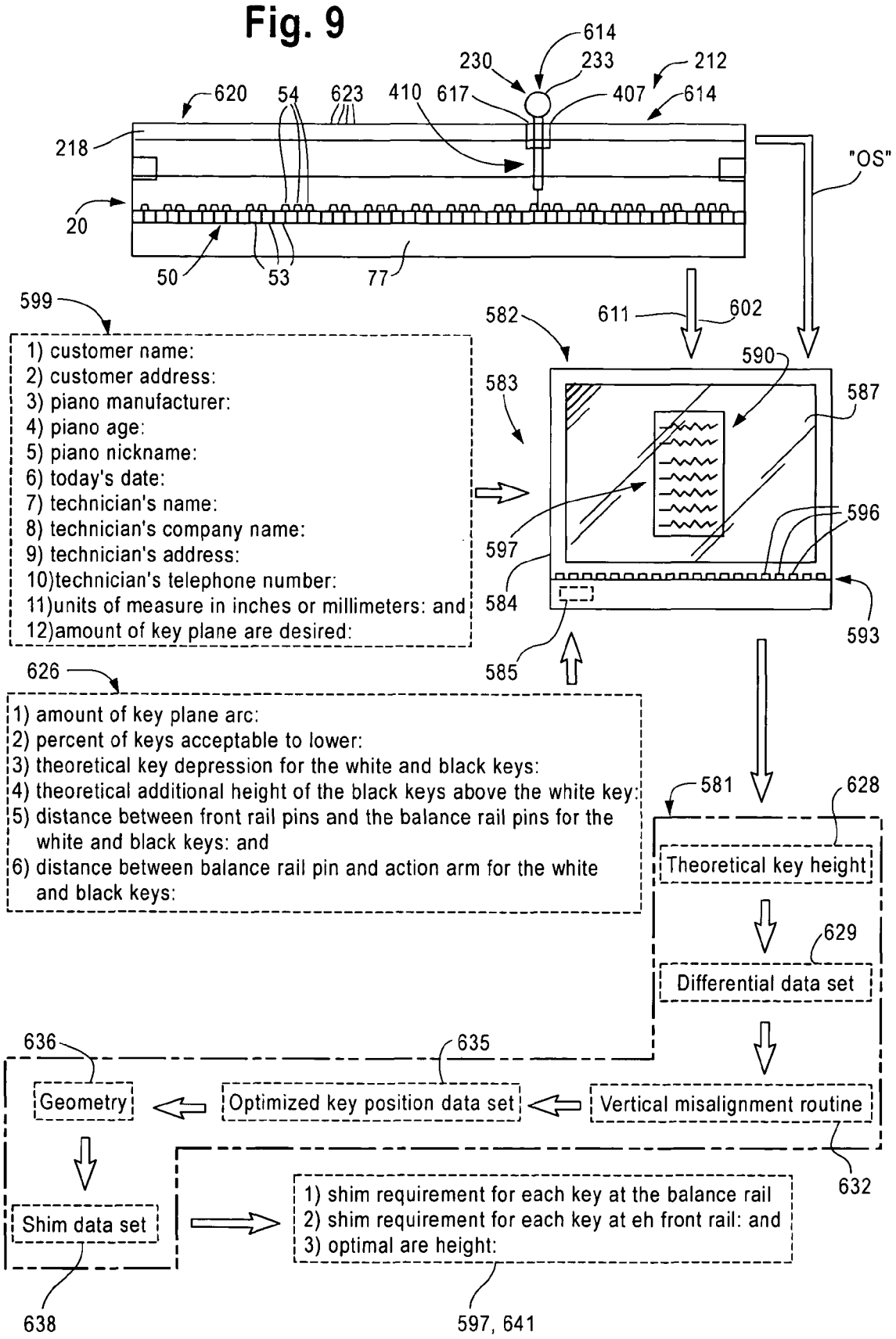
Figure 12:
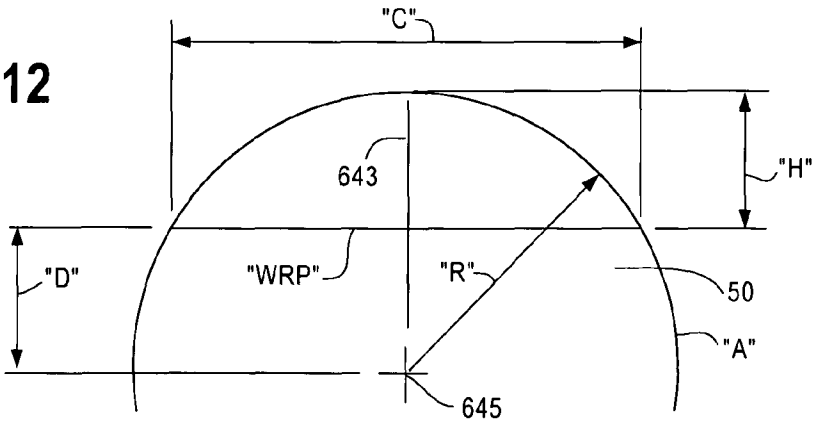
Figure 13:
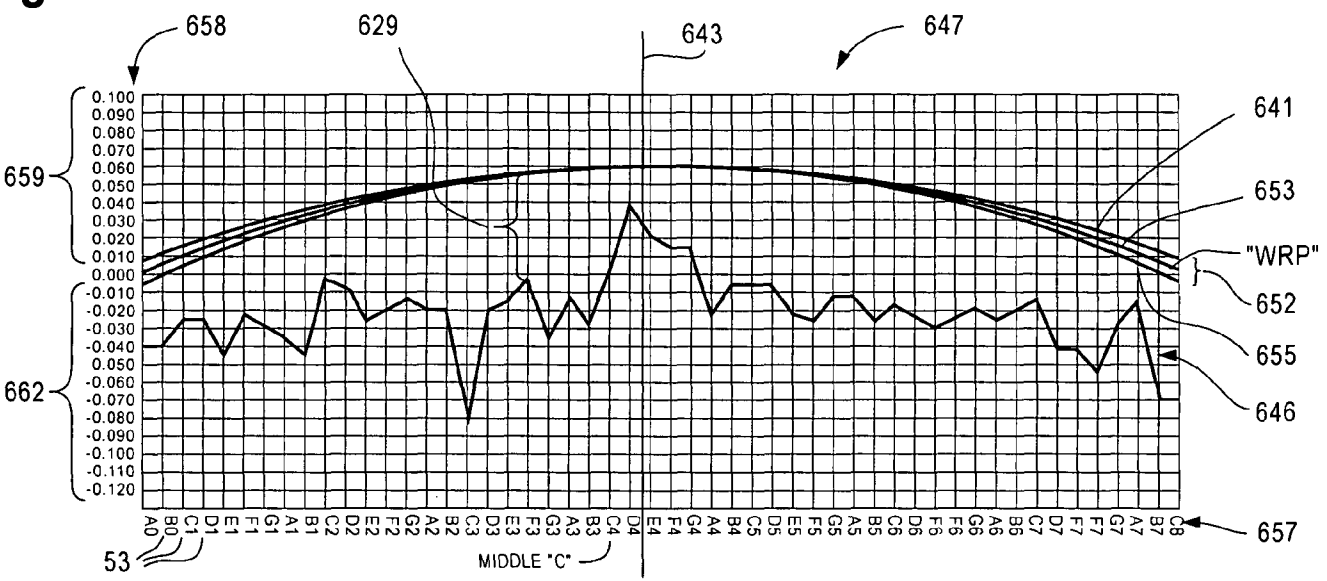
Figure 14:
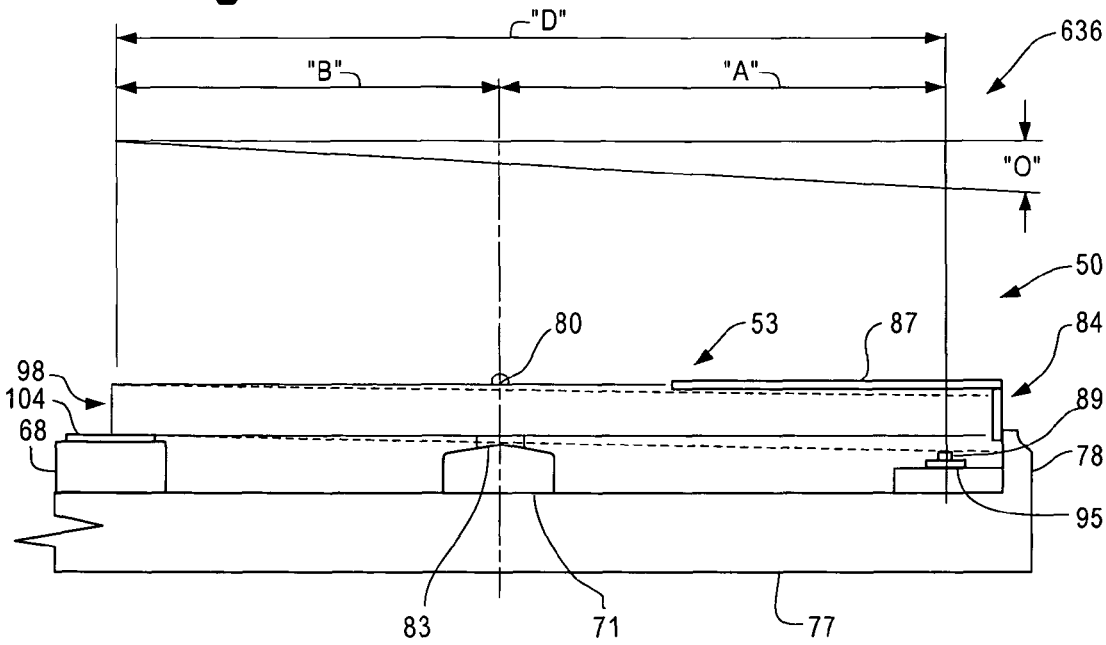
Figure 15:
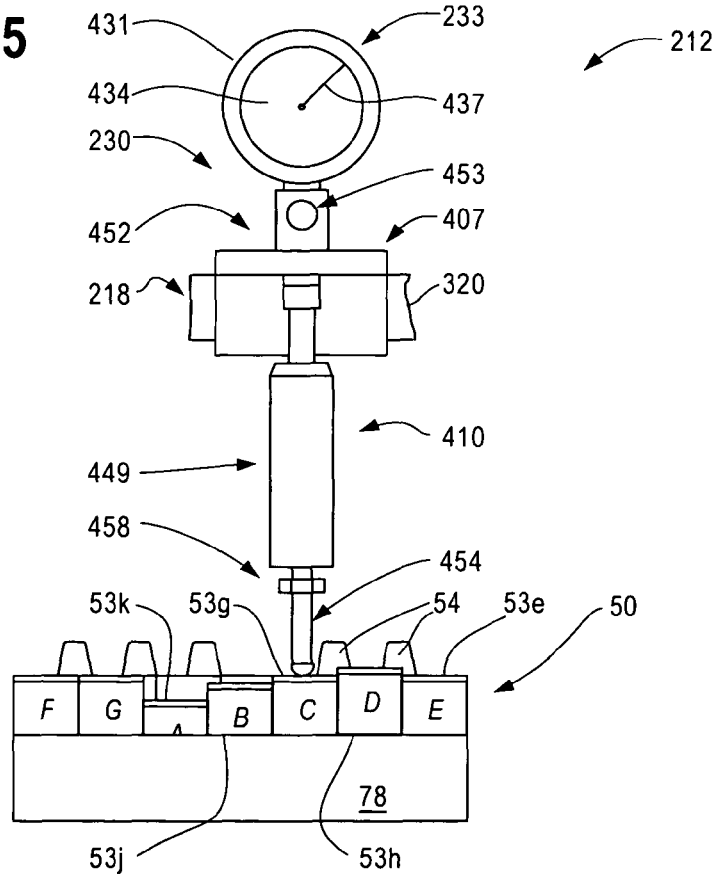
Figure 17:
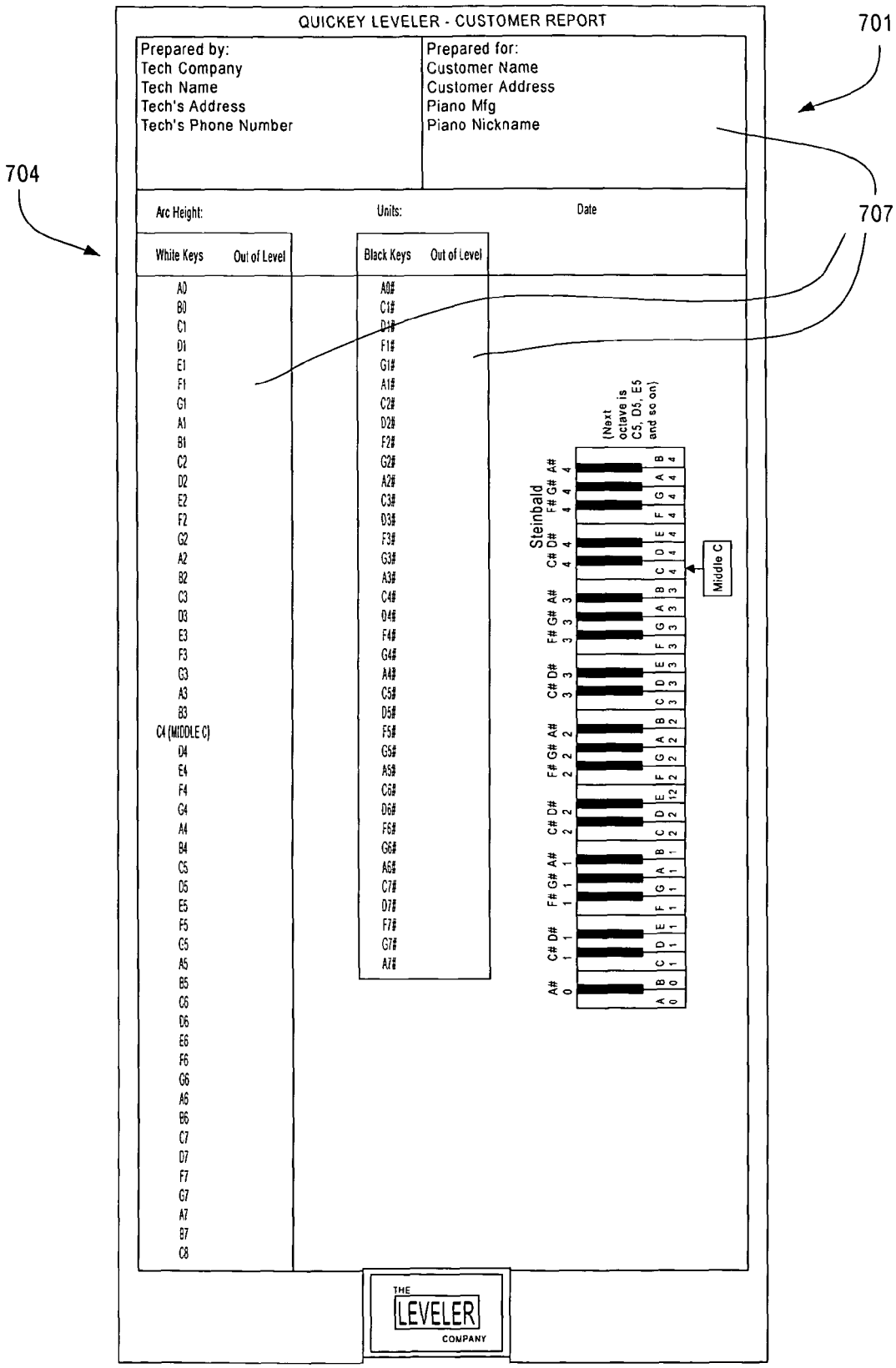

The best mode presently contemplated for carrying out the invention is illustrated in the accompanying drawings, in which:

FIG. 1 is a perspective view of a conventional upright piano that includes a cabinet supported by a plurality of downwardly dependent legs on a ground surface, a music stand, a plurality of pedals supported just above the ground surface by a downwardly dependent pedal support, a keyboard structure enclosed by the cabinet and accessible through a hinged door for servicing, and a keyboard cover is hinged to the cabinet to cover the keyboard structure during periods of non-use;

FIG. 2, a fragmentary longitudinal vertical sectional view of the piano to a first enlarged scale taken on the line 2-2 of FIG. 1 showing the keyboard structure including a keyboard containing a plurality of white and black keys, a hammer assembly, an action mechanism for rotating the hammer assembly, and a plurality of strings retained in a vertical orientation under tension by a string support structure affixed to the cabinet;

FIG. 3, a fragmentary perspective view of the piano with a piano key leveler of the present invention connected to the cabinet at the keyboard to a second enlarged scale;

FIG. 4, a fragmentary front elevational view of the key leveler connected to the cabinet to a third enlarged scale taken on the line 4-4 of FIG. 3, the key leveler including a pair of mounting clamp assemblies that removably mount to the cabinet, a guide rail supported above the keyboard by the mounting clamp assemblies using a pair of swing arms with draw devices, and a gauge holder with a dial indicator is slidably disposed on the guide rail;

FIG. 5, a fragmentary side elevational view of the key leveler connected to the cabinet to the third enlarged scale taken on the line 5-5 of FIG. 4 showing the mounting clamp assemblies mounted to the cabinet, the guide rail, the swing arms with draw devices, and the gauge holder which includes a bearing block slidably connected to the guide rail that holds a gauge holder that retains the dial indicator;

FIG. 6, a fragmentary side elevational view of the guide rail, bearing block, and a pair of the gauge holders that retain respective dial indicators to a fourth enlarged scale in respective front and rear positions used for the white and black keys;

FIG. 7, a fragmentary longitudinal vertical sectional view of the gauge holder to a fifth enlarged scale taken on the line 7-7 of FIG. 5 showing a tubular index cylinder, a tubular gauge holder support, a thumbscrew, an inner rod, a spring adjustment screw, a compression spring, and an extension tip;

FIG. 8, a schematic view of the guide rail, the bearing block, the gauge holder, and the dial indicator disposed above the keyboard to the fourth enlarged scale with the index cylinder disposed in respective rest, depressed, and parked positions above respective of the white keys;

FIG. 9, a flow chart of information in a software program of the present invention used with the key leveler to calculate adjustments to the black and white keys to level the keyboard;

FIG. 10, a schematic view of the keyboard showing how shim requirements for the keys is determined by the software program measuring from a center of the keyboard;

FIG. 11, a table showing standard distances between all of the white keys;

FIG. 12, a schematic diagram showing how the software program produces a theoretical arc on which to calculate individual adjustments to the keys to level the keyboard based on a preferred height for the arc that a piano technician enters, and how the software program uses the theoretical arc to calculate a theoretical height for each key;

FIG. 13, an exemplary graph with vertical key heights shown on a vertical axis and the white keys shown across a horizontal axis, the theoretical arc and measured heights of the keys plotted thereon, and a theoretical adjustment range between respective upper and lower theoretical adjustment curves;

FIG. 14, a schematic view of one white key showing how the software program additionally utilizes vertical key heights in the depressed position to trigonometrically determine how much the technician should shim the keys to bring them to a proper height per the theoretical arc;

FIG. 15, a schematic view of the guide rail, the bearing block, the gauge holder, and the dial indicator disposed above the keyboard to the third enlarged scale showing how the gauge holder is "zeroed" on a middle C white key in the rest position;

FIG. 16, an exemplary screen shot of an input data/output of the software program showing fixed information such as prepared by/for, measured values, and date, and variable information based on "what-if" scenarios in which the technician can adjust arc height and see effects of such adjustment; and FIG. 17, an exemplary screen shot of a printable report showing select data for the technician to use during key leveling and to give to customers as a sales tool for key leveling services.

DETAILED DESCRIPTION OF THE ILLUSTRATED EMBODIMENTS

1. Piano Key Leveler

Referring to FIGS. 3-5, therein is shown a key leveler 212 of the present invention for leveling the white and black keys 53 and 54 on the keyboard 50 of the piano 20. The key leveler 212 includes a mounting device in the form of left and right rail mounting assemblies 214 and 215 that removably connect to the key stop 78 and the key bed 77 of the piano 20. The rail mounting assemblies 214 and 215 support opposite ends 216 and 217 of a guide rail 218 horizontally disposed above the keyboard 50 of the piano 20 using left and right swing arms 221 and 224 with a pair of adjustable length draw devices 227. The rail mounting assemblies 214 and 215 are adjustable to grip pianos 20 and other musical instruments with various vertical gripping distances "GD" such as between the key stop 78 and the key bed 77. The guide rail 218 is of a length "RL" sufficient to extend over all of the keys 53 and 54 on the keyboard 50. A gauge holder assembly 230 is movably slidably disposed along the guide rail 218 to which a height indicator in the form of an electronic or mechanical dial indicator 233 mounts. The dial indicator 233 indicates relative key heights by manually positioning the dial indicator 233 over individual keys 53 and 54 by moving the gauge holder assembly 230 along the guide rail 218 using the dial indicator 233 to determine necessary key adjustments.

The rail mounting assemblies 214 and 215 each include a mounting clamp 236, a pair of mounting pads 239 to engage and grip the piano 20, and a pair of clamp braces 240. Each mounting clamp 236 includes a pair of long and short arms 242 and 245 each of generally L-shape, a plurality of spacer tubes 248, a mounting handle 251, and a pivot block 254. The long arm 242 has respective horizontal and vertical legs 255 and 256 joined at an elbow 257 and that terminate at respective front and rear ends 259 and 260 of the long arm 242. The long arm 242 is comprised of a pair of long arm plates 262 each of L-shape held in a spaced relationship and having a pivot hole 263. The short arm 245 has respective horizontal and vertical legs 264 and 265 joined at an elbow 266 and that terminate at respective front and rear ends 268 and 269 of the short arm 245. The short arm 245 is comprised of a pair of short arm plates 270 each of L-shape held in a spaced relationship and having a pivot hole 271. The pairs of arm plates 262 and 270 are held in the spaced relationship using the spacer tubes 248 retained to the arm plates 262 and 270 using respective bolts 272 and nuts 273. The arms 242 and 245 are pivotally interconnected midway along the vertical leg 256 of the long arm 242 and at the rear end 269 of the short arm 245.

The mounting handles 251 are comprised of a threaded shaft 277, a transverse gripping handle 278, and a pivot pin 281. The gripping handle 278 is affixed to a proximal end 284 of the threaded shaft 277 that threadably engages and extends through the pivot block 254 pivotally connected to the front end 259 of the long arm 242. The threaded shaft 277 is pivotally connected to the elbow 266 of the short arm 245 using the pivot pin 281 that is transversely affixed to a distal end 287 of the threaded shaft 277. Opposite ends 293 of the pivot pin 281 are pivotally disposed in respective of the pivot holes 271 at the elbows 266 of the short arm plates 270. Rotating the mounting handle 251 in opposite rotational directions causes the rear ends 260 and 269 of the arms 242 and 245 to move together to grip and move apart to release the piano 20.

The pivot blocks 254 include a body 296 of rectangular configuration with a threaded hole 297 that threadably engages the threaded shaft 277 of the mounting handle 251. A pair of oppositely laterally extending pivot pins 302 pivotally engage respective of the pivot holes 263 of the front ends 259 of the long arms 242. The body 296 has a threaded hole 305 that threadably engages the threaded shaft 277 of the mounting handle 251.

Each mounting pad 239 comprises a body 307 of rectangular configuration with a pivot hole 308 therethrough and with a flat pad mounting surface 309, and a cushioning pad 310 adhesively affixed thereto to engage the piano 20 in a non-marring manner. The pad 310 is made of a resilient material such as natural or synthetic rubber. The mounting pads 239 are respectively disposed between and pivotally connected to the arm plates 262 and 270 using bolts 311 secured using nuts 312 to engage and grip the piano 20.

The clamp braces 240 are of L-shape having respective horizontal and vertical arms 313 and 314 and a pivot hole 317. The clamp braces 240 are respectively disposed between and pivotally connected to the long arm plates 262 using the bolts 311 and nuts 312 that mount the mounting pads 239. The clamp braces 240 are each of a thickness thin enough to slide in between the outermost white keys 53*a* and 53*b* and next outermost white keys 53*c* and 53*d* engaging the key stop 78 of the piano 20 to prevent slippage of the mounting clamps 236 from the key stop 78. The clamp braces 240 horizontally and vertically align the mounting clamps 236 so that the rail guide 218 is disposed parallel to the key stop 78 along the entire width "KW" of the keyboard 50.

The guide rail 218 is of substantially constant cross-section comprising a rectangular body 320 and a downwardly dependent mounting leg 329 supported by the rail mounting assemblies 214 and 215.

The swing arms 221 and 224 are left- and right-handed mirror images of one another. Each swing arm 221 and 224 comprises a swing plate 332, a rail block 335 affixed thereto inwardly of the swing plates 332 to which the guide rail 218 mounts, and a pair of headed horizontal and vertical adjustment screws 338 and 341. The swing plates 332 have a rounded front section 344 with a front pivot hole 347, an upwardly angled middle section 350, a rectangular rear section 353 of mating shape to the rail block 335 with an upwardly open vertical rail slot 354, and a rounded lower section 356 with a bottom pivot hole 359. The rail block 335 is affixed to the rear section 353 to which the guide rail 218 mounts. The front section 344 is disposed above the lower section 356 interconnected by the middle section 350. The lower sections 356 of the swing plates 332 are pivotally connected to the rear end 260 of one of the long arms 242 using the bolts 311 that extend through the bottom pivot holes 359 and through the pivot holes 263 of the long arm plates 262 of the long arms 242 and are secured using the nut 312. The bolts 311 extend along a pivot axis "PA" for rotation of the swing arms 221 and 224 that allow the guide rail 218 to be positioned over the white and black keys 53 and 54 perpendicular thereto as shown by the right angle "A".

Each rail block 335 is of rectangular configuration having an upwardly open, vertical rail slot 362 that slidably receives the guide rail 218. A pair of threaded adjustment screw bores 365 and 368 respectively extend horizontally and vertically into each rail block 335 to the rail slot 362. The adjustment screws 338 and 341 respectively threadably engage the adjustment screw bores 365 and 368. The vertical adjustment screw 341 is used to vertically position the guide rail 218. The horizontal adjustment screw 338 is used to lock the mounting leg 329 of the guide rail 218 to the rail block 335 at a desired vertical position.

The draw devices 227 each include a first end comprising a draw block 371, a headed draw screw 374, and a second end comprising a pivot block 377. The draw blocks 371 are of rectangular configuration each having an upper end 378 with a non-threaded draw hole 381 through which the draw screw 374 extends. The draw blocks 371 each have a lower end 382 with transverse pivot hole 383 to pivotally connect to the elbow 257 of one of the long arms 242 disposed between and pivotally connected to the long arm plates 262 using the bolt 311 secured by the nut 312. The draw block 371 and the pivot block 377 are interconnected by the draw screw 374.

The draw screw 374 includes a knurled gripping head 384 and a dependent shaft 386. The shaft 386 has a non-threaded proximal section 389 and a threaded distal section 392. The proximal section 389 is closely rotatably received through the draw hole 381 of the draw block 371. The distal section 392 threadably engages the pivot block 377. The draw screw 374 is retained to the draw block 371 using an external snap ring 395 that engages an external snap ring groove 398 of the proximal section 389.

The pivot block 377 is of cylindrical configuration having a threaded draw hole 401 that threadably engages the distal section 392 of the draw screw 374. The pivot block 377 has a transverse threaded pivot bore 404 to pivotally connect to the front sections 344 of the swing arms 221 and 224 at the front pivot holes 347 of the swing plates 332 using a bolt 406.

The draw devices 227 are used to adjust the angle "A" to be perpendicular to the keyboard 50 by rotating the draw screws 374 in a desired rotational direction to change the length of the draw device 227. This pushes or pulls the swing arms 221 and 224 to pivot them about the pivot axis "PA".

Referring to FIGS. 6-8, the gauge holder assembly 230 includes a bearing block 407 that is slidably connected to the guide rail 218 so as to be able to pass over each key 53 and 54 upon hand pushing. A gauge holder 410 mounts to the bearing block 407 that retains the dial indicator 233. The bearing block 407 is of substantially constant cross-section includes a horizontally disposed top plate 413. A pair of integral retaining legs 416 and 419 of L-shape define an opened-bottom rail receiving channel 422 that closely receives the guide rail 218. The top plate 413 extends forwardly and rearwardly of the retaining legs 416 and 419 with a pair of threaded front and rear holes 425 and 428. The front and rear holes 425 and 428 treadably engage the gauge holder 410 in front and rear positions "FP" and "RP" to respectively check the white and black keys 53 and 54 of the piano 20.

The dial indicator 233 is of conventional design including a case 431 that contains a measuring mechanism (not shown) disposed behind a readout disk 434 to provide a measurement readout through a rotary pointer 437. A tubular mounting stem 440 extends downwardly from the case 431. A stylus 443 extends downwardly from the measuring mechanism slidably disposed through the mounting stem 440 that terminates at a rounded measuring tip 446. The stylus 443 is disposed in a vertically downward orientation to operably engage individual of the keys 53 and 54. The dial indicator 233 indicates the relative heights by manually positioning the stylus 443 over individual of the keys 53 and 54 by moving the gauge holder assembly 230 along the guide rail 218 based on movement of the measuring tip 446 of the stylus 443 to determine necessary key adjustments.

The gauge holder 410 includes a tubular index cylinder 449 and a tubular gauge holder support 452. A retaining device in the form of a thumbscrew 453 removably retains the dial indicator 233 to the gauge holder support 452. A push rod 454 closely slidably fits through the gauge holder support 452 extending downwardly past the gauge holder support 452. The push rod 454 is comprised of an inner rod 455 and a coaxial extension tip 456. A spring adjustment screw 458 and a compression spring 461 provide an adjustable compensating force "CF" to the push rod 454 that neutralizes a downward force "DF" exerted by the stylus 443 and weight of the push rod 454. This prevents inadvertently actuating of the keys 53 and 54 by the dial indicator 233.

The index cylinder 449 has a tapered top end 467 and a bottom end 470 through which a longitudinal bore 473 extends. The longitudinal bore 473 is split by a bushing 474 affixed therein into a smooth upper portion 475 in which part of the gauge holder support 452 is slidably disposed and a partially-threaded lower portion 483. A threaded set screw bore 485 extends inwardly into the top end 467 to the longitudinal bore 473 that threadably receives a tipped set screw 488 having an externally threaded body 491 and a tip 494.

The gauge holder support 452 is comprised of a top section 497, an externally threaded middle section 500 that matingly engages the holes 425 and 428 of the bearing block 407, and a bottom section 503. The gauge holder 410 has respective threaded down and unthreaded positions for measuring the rest and depressed positions of the keys 53 and 54. A longitudinal bore 506 extends through the gauge holder support 452 having has an enlarged section 509 at the top section 497. The mounting stem 440 of the dial indicator 233 slidably fits into the enlarged section 509 that defines a stop shoulder 510 to position the mounting stem 440 of the dial indicator 233. The enlarged section 509 is large enough to fit numerous commercially available dial indicators 233, both of an analog and a digital type. A threaded thumbscrew bore 512 extends transversely into the top section 497 to the longitudinal bore 506. The middle section 500 slidably receives the stylus 443 of the dial indicator 233. The bottom section 503 is slidably disposed in the longitudinal bore 473 of the index cylinder 449.

The bottom section 503 of the gauge holder support 452 has longitudinal slot 515 intersected by respective park, rest, and depressed position slots 518, 521, and 522 that extend in a radial direction partly around the bottom section 503. The tip 494 of the set screw 488 is slidably disposed within the slots 515, 518, 521, and 522 to allow positioning the index cylinder 449 in respective park, rest, and depressed positions. In the park position, the extension tip 456 of the push rod 454 is at a proper height to clear of the keys 53 and 54 of the piano 20. In the rest and depressed positions, the extension tip 456 of the push rod 454 is at respective proper heights for measuring heights of the keys 53 and 54 in respective rest and depressed positions.

The thumbscrew 453 includes a knurled gripping knob 524 and a dependent threaded shaft 527 that is threadably received in the thumbscrew bore 512. The shaft 527 has a locking tip 530 that bears against the mounting stem 440 to retain the dial indicator 233 to the gauge holder support 452.

The inner rod 455 includes a head 533 having a bottom end surface 534 that closely slidably fits within the lower portion 483 of the longitudinal bore 473 of the index cylinder 449 disposed below the bushing 474. A shaft 536 is upwardly dependent from the head 533 that closely slidably extends through the bushing 474 and the longitudinal bore 506 of the gauge holder support 452. The shaft 536 has a top end surface 539 that engages the measuring tip 446 of the stylus 443 for the dial indicator 233 to gauge from. The bushing 474 acts as an upper stop for the inner rod 455. A threaded bore 541 extends longitudinally into the head 533 from the bottom end surface 534 of the inner rod 455. The inner rod 455 is upwardly spring-biased against the stylus 443 of the dial indicator 233 to provide the compensating force.

The spring adjustment screw 458 includes a knurled gripping head 545 and an upwardly dependent, externally threaded body 548 with a top surface 551 that engages the spring 461. The body 548 threadably engages the lower section 483 of the longitudinal bore 473. The spring adjustment screw 458 has a longitudinal bore 554 through which the extension tip 456 slidably coaxially extends to adjustably engage the gauge holder support 452 and bear against the spring 461 to allow the compensating force to be adjusted.

The compression spring 461 is vertically disposed within the longitudinal bore 473 of the index cylinder 449 about the inner rod 455 between the bushing 474 and the spring adjustment screw 458. The spring 461 has opposite top and bottom ends 557 and 560 that respectively engage the bottom end surface 534 of the inner rod 455 and the top surface 551 of the spring adjustment screw 458. Since most dial indicators 233 have an internal spring or oiler mechanism (not shown) that produces the downward force at the measuring tip 446. This downward force is great enough to actuate the keys 53 and 54 making it difficult to take measurements of the keys 53 and 54 in the rest positions. To counteract this downward force, the spring 461 has an initial spring force that is slightly less than the downward force plus gravity and frictional forces to move the inner rod 455 and the stylus 443 of the dial indicator 233 upwardly. The spring 461 has a spring constant such that turning the spring adjustment screw 458 allows the compensating force to be applied regardless of whether the index cylinder 449 is in the park, rest, or depressed position.

The extension tip 456 includes a rounded head 563 and an upwardly dependent rod 566 that is closely slidably received through the longitudinal bore 554 of the spring adjustment screw 458. The rod 566 has a top end surface 567 that engages the bottom end surface 534 of the inner rod 455. The inner rod 455 and the extension tip 456 are retained together by an externally threaded stud 569 that extends longitudinally upwardly from the top end surface 567 of the extension tip 456 that is threadably received in the threaded bore 541 of the inner rod 455. The extension tip 456 has a convex bottom surface 572 that contacts the top surfaces 87 and 207 respectively of the white and black keys 53 and 54.

As shown in FIG. 6, the gauge holder 410 has a completely threaded down position as shown by the right hand gauge holder 410 in the front position "FP" disposed in the front hole 425 of the bearing block 407 for measuring the rest and depressed positions of the white keys 53. The gauge holder 410 also has an unthreaded or nearly unthreaded position as shown by the left hand gauge holder 410 in the rear position "RP" disposed in the rear hole 428 of the bearing block 407 for measuring the rest and depressed positions of the black keys 54.

2. Key Leveler Setup

The key leveler 212 is used by first mounting the rail mounting assemblies 214 and 215, the swing arms 221 and 224, and the draw devices 227 to the piano 20 as respective left and right rail mounting assemblies 575 and 578. This is accomplished by rotating the mounting handles 251 such that the mounting pads 239 of the mounting clamps 236 are spread apart a distance greater than the vertical gripping distance "GD" between the key stop 78 and the key bed 77. The mounting clamps 236 are mounted to the piano 20 and the mounting handles 251 rotated to tighten the mounting pads 239 with the cushioning pads 310 against respective of the key stop 78 and the key bed 77.

The guide rail 218 with the gauge holder assembly 230 and the dial indicator 233 assembled thereto is then mounted to the rail mounting assemblies 575 and 578. This is done by slipping the mounting leg 329 of the guide rail 218 into the vertical rail slots 354 and 362 of the swing arms 221 and 224. The guide rail 218 is laterally leveled along the width "KW" of the keyboard 50 using a bubble level (not shown) placed longitudinally thereon and rotating the vertical adjustment screws 341 as needed. Once lateral leveling is completed, the horizontal adjustment screws 338 are tightened to lock the guide rail 218 to the rail mounting assemblies 575 and 578. Then the guide rail 218 is longitudinal leveled from front to rear of the piano 20 using the bubble level placed transversely thereon and rotating the draw screws 374 to push or pull the swing arms 221 and 224 to rotate about the pivot axis "PA". This assures that the guide rail 218 is parallel with the white keys 53 and black keys 54 of the keyboard 50 including height-wise above the keyboard 50.

3. Measuring the White Keys

The rest and depressed positions of the white keys 53 are measured by assembling the gauge holder 410 to the front hole 425 of the bearing block 407 disposed in the completely threaded down position. At this point, the tip 494 of the set screw 488 is disposed in the park position slot 518 such that the head 563 of the extension tip 456 clears the white keys 53 and black keys 54. Measuring begins by rotating the index cylinder 449 so the tip 494 of the set screw 488 enters the longitudinal slot 515. The index cylinder 449 is moved downwardly, then rotated such that the tip 494 of the set screw 488 enters the rest position slot 521 so the rest position measurements of the white keys 53 may be taken. The dial indicator 233 is then zeroed and rest position measurements taken. The gauge holder assembly 230 with the dial indicator 233 is slid along the guide rail 218 such that the gauge bolder 410 is disposed over another white key 53 to continue the leveling process.

Depressed position measurements of the white keys 53 are taken by rotating the index cylinder 449 so the tip 494 of the set screw 488 enters the longitudinal slot 515. The index cylinder 449 is moved downwardly, then rotated such that the tip 494 of the set screw 488 enters the depressed position slot 522 so the depressed position measurements of the white keys 53 may be taken. The gauge holder assembly 230 with the dial indicator 233 is slid along the guide rail 218 such that the gauge bolder 410 is disposed over another white key 53 to continue the leveling process.

4. Measuring the Black Keys

The rest and depressed positions of the black keys 54 are measured by rotating the index cylinder 449 so the tip 494 of the set screw 488 enters the longitudinal slot 515. The index cylinder 449 is moved upwardly, then rotated such that the tip 494 of the set screw 488 enters the park position slot 518. The gauge holder 410 is unthreaded from the rear hole 428 and placing it through the front hole 425 of the bearing block 407 disposed in the completely unthreaded or nearly unthreaded up position. Measuring begins by rotating the index cylinder 449 so the tip 494 of the set screw 488 enters the longitudinal slot 515. The index cylinder 449 is moved downwardly, then rotated such that the tip 494 of the set screw 488 enters the rest position slot 521 so the rest position measurements of the black keys 54 may be taken. The dial indicator 233 is then zeroed and rest position measurements taken. The gauge holder assembly 230 with the dial indicator 233 is slid along the guide rail 218 such that the gauge bolder 410 is disposed over another black key 54 to continue the leveling process.

Depressed position measurements of the black keys 54 are taken by rotating the index cylinder 449 so the tip 494 of the set screw 488 enters the longitudinal slot 515. The index cylinder 449 is moved downwardly, then rotated such that the tip 494 of the set screw 488 enters the depressed position slot 522 so the depressed position measurements of the black keys 54 may be taken. The gauge holder assembly 230 with the dial indicator 233 is slid along the guide rail 218 such that the gauge bolder 410 is disposed over another black key 54 to continue the leveling process.

5. Hardware/Software Operation

Referring to FIG. 9, the piano key leveler 212 may be used with a software program 581 of the present invention to calculate adjustments to the keys 53 and 54 to level the keyboard 50. The software program 581 is preferably then run on a laptop computer 582 as part of a computerized key leveling system 583 of the present invention. The laptop computer 582 is used for portability, though a desktop or other type of computer (not shown) can be used. The dial indicator 233 is then of an electronic type that indicates relative heights as an electronic output signal "OS" received by the laptop computer 582.

The laptop computer 582 includes a case 584 that contains a microprocessor 585 and related electronics (not shown) that receive the output signals "OS" from the key leveler 212. A display device in the form of a liquid crystal display 587 allows viewing of one or more screens 590 produced by the software program 581. A keyboard 593 includes a plurality of keys 596 to allow the technician to manual enter user-defined input parameters and commands to control the software program 581.

The software program 581 simultaneously calculates optimal shimming for all of the keys 53 and 54 to level the keyboard 50 based on the input parameters and the output signals "OS" from the dial indicator 233. The software program 581 produces the screens 590 on the display 587 for viewing output data 597 including optimal shimming (balance rail washer 83, front rail washer 95, and shims 205) for the piano 20 to level the keys 53 and 54. This optimal shimming requires the least amount of shimming done to a minimum amount of the keys 53 and 54 to achieve the key leveling.

6. Entering Initial Information

Once the piano key leveler 212 has been set-up and positioned correctly on the piano 20, the technician enters initial information 599 into the software program 581 for reporting and calculation purposes. The initial information 599 includes: 1) customer name; 2) customer address; 3) piano manufacturer; 4) piano age; 5) piano nickname; 6) today's date; 7) technician's name; 8) technician's company name; 9) technician's address; 10) technician's telephone number; 11) units of measure in inches or millimeters; and 12) amount of key plane arc desired.

7. Measuring and Entering Key Level Data

The technician slides the gauge holder assembly 230 with the dial indicator 233 across the white keys 53 noting rest height and depressed height as a rest and depressed key level data 602. The gauge holder 410 is then repositioned on the bearing block 407 as explained above and the process is repeated for the black keys 54. The key level data 602 of the keys 53 and 54 is then fed into the software program 581. The key level data 602 is a number from negative one to positive one inch. The dial indicator 233 of the digital type sends the key level data 602 as the output signal "OS" directly to the computer 582 through a data cable 611. Alternatively, the key level data 602 may be written down then manually entered into the computer 582 using the keyboard 593. The software program 581 prompts the technician to press specific the keys 596 of the keyboard 593 to accept the key level data 602 as taken from each of the white keys 53 then from each of the black keys 54. A conventional position indicator device 614 can be used that includes a laser, magnetic, or other sensor 617 mounted to the bearing block 407 and a grid 620 of optical, magnetic, or other position markers 623 mounted to the guide rail 218. This arrangement automatically ques the software program 581 which of the keys 53 or 54 is being measured.

The technician also notes certain common dimensional features of the keys 53 and 54 that relate to the piano's action 55 to compute optimal adjustments to make.

8. Entering Key Position Information

Additionally to the key level data 602 received from the piano key leveler 212, desired key position information 626 is input including: 1) amount of key plane arc (positive number from zero to one-tenth of an inch to compensate for more usage of center white and black keys); 2) percent of keys acceptable to lower (zero percent for a relatively new piano, ten percent for a partial restoration, and one-hundred percent for a complete rebuild); 3) theoretical key depression for the white and black keys (default three-eights inch, positive number from one-eighth to one-half inch); 4) theoretical additional height of the black keys above the white keys (default one-half inch, positive number from three-eighths to three-quarters inch); 5) distance between front rail pins and the balance rail pins for the white and black keys (positive number from zero to ten inches); and 6) distance between balance rail pin and action arm for the white and black keys (positive number from zero to ten inches).

The software program 581 uses the entered values of key plane arc, theoretical key depression for black and white keys, and theoretical height of the black keys above the white keys to calculate a theoretical key height 628 of the keys 53 and 54 in the rest and depressed positions. This is compared to the measured values of the key level data 602 to produce a differential data set 629. The differential data set 629 is manipulated based on the entered value of percent of keys acceptable to lower and a vertical misalignment routine 632 to produce an optimized key position data set 635 of minimum amounts of washer and shim adjustments to the keys 53 and 54.

The software program 581 uses the optimized key position data set 635, and key geometry 636 (see also FIG. 14) including a distance "A" between the balance rail pins 80 and the front rail pins 89 and a distance "B" between the balance rail pins 80 and the back rail cloth 104 affixed to the back rail 68 to calculate a shim data set 638. The shim data set 638 tells the technician how much shimming needs to be added or removed under each key 53 and 54 at the balance rail 71 to bring them into proper rest positions.

The software program 581 also uses the optimized key position data set 635 and the theoretical key depression for the keys 53 and 54 to calculate how much shimming needs to be added or removed under each key 53 and 54 at the front rail 74 to bring the to bring the keys 53 and 54 into proper depressed positions.

The software program 581 also may be used to give a recommended key plane arc 641 (FIG. 13) based on the key level data 602, the entered value of percent of keys acceptable to lower, and the optimized key position data set 635 produced by the vertical misalignment routine 632.

The software program 581 produces output information 639 that includes the output data 597 to the technician with essential pieces of information of: 1) shim requirement for each key 53 and 54 at the balance rail 71; 2) a shim requirement for each key 53 and 54 at the front rail 74; and 3) optimal arc height.

9. Key Leveling

The piano's action 55 is a complex mechanism that is time consuming to adjust. The ultimate goal of the piano key leveler 212 and software program 581 is to make a comprehensive evaluation of the positions of the keys 53 and 54 so they can be brought to "level" with minimum shimming. This reduces the likelihood that other adjustments will be needed to the piano's action 55.

Leveling the keys 53 and 54 is actually a misnomer since leveling often refers to bringing something into a straight horizontal line. The piano key leveler 212 with software program 581 levels the keys 53 and 54 in the sense that they provide a "level" playing surface for piano players. It is often desirable to arc the rest planes "WRP" and "BRP" and the depressed planes "WDP" and "BDP" respectively of the white keys 53 and black keys 54. The keys 53 and 54 closest to the middle portion 210 of the keyboard 50 are played the most so the wear thereto is greatest. If the technician provides a slight arc, the keys 53 and 54 wear more evenly and require leveling less frequently. However, some piano players prefer a non-arced keyboard 50. The software program 581 allows for this by entering a zero value for the arc height, essentially making the arc a straight line.

10. Key Spacing and Shimming

FIG. 10 is a schematic view of the keyboard 50 showing how shim requirements for the keys 53 and 54 is determined by the software program 581 measuring from a center 643 of the keyboard 50 found between the E and F white keys 53*e* and 53*f* just to the right of the middle C key 53*g*. These keys 53*e* and 53*f* are also referred to as E4 and F4 since they are found in the fourth octave. Respective key spacings "KS" listed as A-Z between respective centers "KC" of all the white keys 53 is standard as given in FIG. 11, such as the key spacing "A" between the E and F white keys 53*e* and 53*f*, and the key spacing "B" between respective D and G white keys 53*h* and 53*i*.

Adjusting the rest height of the keys 53 and 54 at the balance rail 71 by adding or removing shims 205 at the balance rail 71 determines how high or low the particular key 53 or 54 is positioned. This determines how "level" the keys 53 and 54 will be in the rest position. Adjusting the height of the front rail washer 95 determines how far down the particular key 53 or 54 can be depressed. This distance is critical to the feel of the piano 20 and how the piano's action 55 is adjusted. The optimal adjustment will save the technician time and prevent excessive adjustment to the piano's action 55.

11. Geometry

FIG. 12 schematically shows how, after the technician enters a desired arc height "H" of a theoretical arc "A" above the rest plane "WRP" of the white keys 53, the software program 581 produces the theoretical arc "A" on which to calculate individual adjustments to the keys 53 and keys 54. The theoretical arc "A" is placed on the keyboard 50 with a chord length "C" where the theoretical arc "A" intersects the centers "KC" of the outermost white keys 53*a* and 53*b* along the rest plane "WRP". The chord length "C" is the same as the furthest key distance "Z" of FIG. 11. The arc height "H" is found at the center 643 of the keyboard 50 between the white keys 53*e* and 53*f* (E4 and F4). An arc radius "R" of the theoretical arc "A" is ascertainable since we know the arc height "H" and the chord length "C". The arc radius "R" is calculated using the formula $R-(C^2/8H)+(H/2)$. A vertical distance "D" from the rest plane "WRP" of the white keys 53 to a center 645 of the theoretical arc "A" is computed using the formula $H=R-D$.

The software program 581 uses the theoretical arc "A" to calculate the theoretical key height 628 for each white key 53. Since the arc radius "R" is constant for all key positions and the key spacing "KS" between the centers "KC" of all the white keys 53 is known (FIG. 11), the theoretical key height 628 of each white key 53 on the theoretical arc "A" can be calculated. This is done by working outwardly from the center 643 of the keyboard 50 using the formula $C=2\ \mathrm{sqrt}\ [H(2R-H)]$. Solving this formula for "H" gives the formula $H=R-((0.5\times\mathrm{sqrt}\ (4R^2-C^2))$. Since the arc radius "R" is constant and the key spacing "KS" (FIG. 11) between the centers "KC" of all the white keys 53 is known, the theoretical key height 628 of each white key 53 may be calculated.

12. Raw Data Set

Shown in FIG. 13 is exemplary raw data 646 as measured using the key leveler 212 plotted on a graph 647 produced by the software program 581 used to calculate the individual adjustments 649 to the keys 53 and 54. The individual adjustments 649 place the keys 53 and 54 within a theoretical adjustment range 652 defined by respective upper and lower theoretical adjustment curves 653 and 655 adjacent the recommended key plane arc 641 computed by the software program 581 based on the theoretical arc "A". The graph 647 has a horizontal axis 657 along which the white keys 53 are represented. A vertical axis 658 of the graph 647 has the rest plane "WRP" of the white keys 53 with respective plus height values 659 and minus height values 662 referenced therefrom.

The first step in analyzing the raw data 646 is to understand that the key leveler 212 is zeroed at a reference position 674 of the keyboard 50, usually the white key 53*g* (middle C). This reference position 674 may not be the highest or lowest point on the keyboard 50. If the reference position 674 is low, all of the raw data 646 must be subtracted by some value to bring the raw data 646 as close to the recommended key plane arc 641 (or the theoretical arc "A" if so desired) as possible. The opposite holds true if the reference position 674 is high. Addition or subtraction is used between the recommended key plane arc 641 and the raw data 646 to determine a key misplacement "C" (FIG. 14) indicating how far each white key 53 is out of level. Out of level is simply how far the white key 53 is from the recommended key plane arc 641. The recommended key plane arc 641 shown on the graph 647 has a height of sixty-thousandths of an inch.

A hierarchy of item importance in determining the recommended key plane arc 641 is: 1) the least amount of disruption to the keys is the most desirable; 2) it is more desirable to raise keys than to lower keys since it is easier to add shims that to remove them (the input percentages are used to make this determination); 3) manufacturing tolerances and angular misalignment of the apparatus where one edge of the key is higher than another (a total maximum difference from the furthest keys should not be more than fifteen-thousandths of an inch and the raw data should be manipulated to compensate for this by adjusting the slope of the theoretical curve); and 4) extreme data points should be negated since these keys require special attention and skew the raw data (they should be noted, though).

13. Determining White Key Balance Rail Shimming Requirements

FIG. 14 schematically shows one white key 53 of the keyboard 50 and how trigonometric formulas are used to determine how much the white keys 53 (the same holds true for the black keys 54 using the proper dimensions) should be shimmed at the balance rail 71 to bring each white key 53 to the theoretical key height 628. The amount of shimming required is based on the thinnest commercially available shim 205 of one-thousandth of an inch thick. Shown are: 1) the distance "A" from the balance rail pin 80 to the front rail pin 89; 2) the distance "B" from the balance rail pin 80 to the rear end 98 of the white key 53 at the back rail 68; 3) the key misplacement "C"; 4) a distance "D"=A+B; 4) a needed shimming "S" to be added or removed from under the white key 53 at the balance rail 71 to level; and 5) a key misplacement angle "O". The distances "A", "B", and "C" are measured and entered by the technician by measuring a white key 53. The distance "D" is calculated using simple addition. The key misplacement angle "O" is calculated for each white key 53 using the formulas: 1) $\tan O=C/D$; and 2) $O=\arctan (C/D)$. Once the key misplacement angle "O" is calculated, the shimming "S" is calculated for each white key 53 using the formulas: 1) $\tan O=S/B$; and 2) $S=\tan O\times B$. The shimming "S" is a positive number when the shims 205 need to be added and a negative number when the shims 205 need to be removed from under the white key 53 at the balance rail 71 to level.

14. Determining Black Key Balance Rail Shimming Requirements

The black keys 54 are theoretically disposed at the theoretical additional height above the white keys 53 previously entered by the technician. However, since the black keys 54 are always disposed between two white keys 53, the theoretical key height 628 for each black key 54 is calculated by averaging the theoretical key height 628 of the white keys 53 immediately on each side of the black key 54 and adding the theoretical additional height.

The black keys 54 are included in manipulating the raw data 646 to minimize disruption to the keys 53 and 54 to determine how far the black keys 54 are out of level. A similar trigonometric evaluation must be performed using the raw data 646 of the black keys 54 to determine the amount of shims 205 that need to be added or removed at the balance rail 71 to get the black keys 54 to level in the rest position. The same trigonometric functions apply as explained above.

15. Determining White and Black Key Front Rail Shimming Requirements

The theoretical key depression for the white and black keys 53 and 54 previously entered by the technician is simply subtracted (or added) from the recommended key plane arc 641 (or the theoretical arc "A" if so desired). This is done keeping in mind the optimization of the raw data 646 when the keys 53 and 54 are in the rest position. No trigonometric calculations are necessary for calculating the depressed positions since the shims 205 are disposed at the front rail pins 89.

The software program 581 utilizes the measured heights of the keys 53 and 54 in the depressed position to trigonometrically determine how much the technician needs to shim the keys 53 and 54 to bring them to the proper position per the recommended key plane arc 641. Once it is determined how far each white key 53 is out of level, the desired key position information 626 inputs are used to determine what the technician should do to level the keys 53 and 54.

16. Understanding Key Position Data (Positive and Negative Values)

FIG. 15 shows the guide rail 218, the dial indicator 233, the bearing block 407, and the gauge holder 410 of the piano key leveler 212 as mounted to the cabinet 23 of the piano 20. The guide rail 218 is disposed above the keyboard 50 with the gauge holder 410 "zeroed" on the white key 53*g* (middle C) in the rest position. The gauge holder 410 is in the completely threaded down position disposed in the front hole 425 of the bearing block 407 for measuring the rest and depressed positions of the white keys 53. The technician slides the gauge holder assembly 230 with the dial indicator 233 across the white keys 53 noting the rest and depressed heights of each as the key level data 602. The gauge holder 410 is then repositioned on the bearing block 407 as explained above and the process is repeated for the black keys 54.

It is important to note that the key leveler 212 is "zeroed" on the white key 53*g* in the rest position as a matter of convenience for the technician. Any measured height value below the white key 53*g* is reported as a negative value. In the rest position, the position of any white key 53 is negative if it is below the level of the white key 53*g* as illustrated by the B white key 53*j*. Likewise, the position of any white key 53 is positive if it is above the level of the white key 53*g* as illustrated by the D white key 53*h*. The depressed position of the white keys 53 is always negative as illustrated by the A white key 53*k*. The rest position of the black keys 54 is always positive. The depressed position of the black keys 54 is most likely be positive, but a negative value is possible if the black keys 54 dip below the white key 53*g* in the rest position.

17. Software Program

The software program 581 is preferably written for the MicroSoft Windows™ operating system on the laptop computer 582 for universal use and portability to and from the location of the piano 20. However, the software program 581 may be adapted to run on any desired computer platform and in any programming language. Likewise, the software program 581 may be converted for use on personal data assistant (PDA) type devices and on the Internet. The software program 581 may be distributed or used in any manner desired such as a compact disk package (not shown), Internet download, or online Internet data entry to a mainframe computer (not shown). It is desirable that software code be "locked" and encrypted to prevent copying by competitors and pirating.

18. Interface, Data Storage, and Reporting

FIG. 16 shows an exemplary screen shot 677 of input data 680 and output data 683 by the software program 581. The key level data 602 received from the key leveler 212 and the desired key position information 626 is input as the input data 680 that includes fixed information 686 such as prepared by/for, measured values, and date. The input data 680 also includes variable information 698 based on "what-if" scenarios in which the technician can adjust the desired arc height "H" of the theoretical arc "A" to see effects of such adjustment in the output data 683. The technician can switch the input data 680 and output data 683 to view in inches or millimeters as desired. That is, if the input data 680 is entered in inches with inches as the selected units, the output data 683 will be displayed in inches. If millimeters is then selected, all of the input data 680 and output data 683 is converted to millimeters. All of the input data 680 and output data 683 is stored in a file (not shown) under a user-defined file name. The input data 680 and output data 683 is organized in the file so that it can easily be extracted and placed into a larger data base (not shown).

19. Reporting

FIG. 17 shows an exemplary screen shot 701 of a printable report 704 showing select data 707 for the technician to use during key leveling and to give to customers as a sales tool for key leveling services.

20. Method of Use

A method of leveling keys on keyboards of keyed musical instruments comprises the steps of: A) providing a musical instrument having a plurality of keys on a keyboard; B) providing a key leveler that includes; 1) a guide rail of sufficient length to extend over all of the keys on the keyboard; 2) a mounting device adapted to connect to the musical instrument to support said guide rail horizontally disposed above the keyboard; 3) a height indicator that indicates relative heights using a stylus slidably disposed through a mounting stem that terminates at a measuring tip; and 4) a gauge holder assembly movably disposed along the guide rail to which the height indicator mounts with the stylus disposed in a vertically downward orientation to operably engage individual keys; and wherein the height indicator indicates relative key heights based on movement of the tip of the stylus; C) mounting the key leveler to the musical instrument using the mounting device such that the stylus operably contacts the keys; D) taking readings of relative key heights in rest positions from the height indicator by positioning the stylus over individual keys by moving the gauge holder assembly along the guide rail; E) determining necessary key adjustments for the keys in the rest positions based on the relative key heights; F) leveling the keyboard by adjusting rest position heights of at least some of the keys based on the necessary key adjustments; and G) dismounting the key leveler from the musical instrument by releasing the mounting device.

In a preferred method, the step of taking readings includes individually placing the keys in a depressed position and taking additional readings of relative key heights. The step of determining necessary key adjustments is also done for the keys in the depressed positions. The step of leveling the keyboard includes adjusting depressed key heights. The step of determining necessary key adjustments is done with reference to a middle C key of the keyboard. The step of mounting the key leveler includes vertically and pivotally adjusting the key leveler so the guide rail is parallel over the keyboard.

The musical instrument provided may have a plurality of black keys of elevated height interspersed between a plurality of white keys. Then, the step of determining the necessary key adjustments is initially done with the height indicator disposed in a first position on the gauge holder assembly for measuring one of the white keys and the black keys. The method then includes a further step of repositioning the height indicator to a second position on the gauge holder assembly and repeating the steps of positioning the stylus, taking the readings, and determining the necessary key adjustments for another of the white keys and the black keys. The step of leveling the keyboard is then done for the white keys then for the black keys.

A method of determining key adjustments for leveling keys on keyboards of musical instruments comprises the steps of: A) providing a key leveling software program run on a computer; B) entering dimensional data common to the keys that relate to the musical instrument's action into the computer accessible by the software program including: 1) theoretical key depression for the keys; 2) distance between front rail pins and balance rail pins for the keys; and 3) distance between balance rail pin and action arm for the keys; C) entering desired key position information into the computer accessible by the software program of: 1) a desired key arc plane to compensate for more usage of center keys chosen from the group consisting of a straight plane, an arced plane, and an optimized plane; and 2) percent of keys acceptable to lower; D) entering measured key height data into the computer accessible by the software program; and E) the software program uses the dimensional data of the keys and the desired key position information to: 1) calculate a theoretical height of the keys in the rest and depressed positions based on the desired key arc plane; 2) comparing to the measured key height data to produce a differential data set; 3) manipulating the differential data set, and the desired key arc plane for the optimized plane, based on the entered value of percent of keys acceptable to lower and a vertical misalignment routine to produce an optimized key position data set of least amounts of key adjustments at the balance and front rails; 4) using the optimized key position data set and the dimensional data to calculate a shim data set of how much shimming needs to be changed under each key at the balance and front rails to level the keys; and 5) outputting the shim data for each key for a technician to level all of the keys in the rest and depressed positions, and an optimal arc height for the optimized plane.

A preferred method is for musical instruments that have a plurality of black keys of elevated height interspersed between a plurality of white keys. The software program allows running of what-if scenarios based on different desired arc heights of the theoretical arc to see effects of such adjustment in the results. The method includes the step of entering initial information into the computer accessible by the software program for reporting and calculation purposes chosen from the group consisting of: 1) customer name; 2) customer address; 3) piano manufacturer; 4) piano age; 5) piano nickname; 6) today's date; 7) technician's name; 8) technician's company name; 9) technician's address; 10) technician's telephone number; and 11) units of measure in inches or millimeters. The optimized plane is determined using a hierarchy of item importance of: 1) a least amount of disruption to the keys; 2) raising rather than lowering the keys; 3) manufacturing tolerances and angular misalignment where one edge of a key is higher than another; and 4) extreme data points are negated since these keys skew the raw data. The steps of entering the dimensional data, the desired key position information, and the measured key height data is done for both the white and the black keys. The step of entering the desired key position information includes entering a theoretical additional height of the black keys above the white keys. The software program calculates the theoretical height of each black key by averaging the theoretical height of the white keys immediately on each side thereof and adding the theoretical additional height. The software program outputs the shim data for both the white and black keys.

21. Summary

The key leveler 212, the software program 581, and the computerized key leveling system 583 make a holistic analysis of the keys 53 and 54 of the keyboard 50. This prevents over adjustment of the keys 53 and 54 and greatly increases the probability that some keys 53 and 54 will not need any adjustment. It also gives the technician the ability to run optimization or "what-if" scenarios whereby the theoretical arc "A" is adjusted to produce the recommended key plane arc 641 that minimizes the number of keys 53 and 54 that need adjusting. This maximizes the number of keys 53 and 54 that need no adjustment and minimizes the amount of adjustment to those that do, resulting in minimal readjustment of the action 55.

Likewise, the technician can remove all of the keys 53 and 54 at one time making adjustments to the rest and depressed state of the keys all at one time. The removal of all the keys 53 and 54 exposes all of the balance and front rail pins 80 and 89 allowing for easy access to the balance and front rail washer 83 and 95 and eliminates the need to remove the shims 205 from confined spaces. Since the technician can remove all of the keys 53 and 54 at once creating an open work area, and since this only needs to be done once, leveling the keys 53 and 54 is much less tedious and time consuming. Results are less likely to be affected by the technician's skill and patience.

The apparatus and method described in this invention significantly reduces the time required to level the keys in both at rest and depressed positions, removes the guess work by the technician and prevents over-adjustment. The invention takes a holistic approach to the measurement and adjustment of the keys eliminating the need to remove and reassembly of the keys multiple times, eliminates the trial and error approach to achieving the proper key height, and prevents over-adjustment. The apparatus and method guides the technician so that the keys can be placed in a straight plane, arced plane or optimized plane. This invention allows the technician to accurately measure the key position in the rest and depressed states, this data is then evaluated using a mathematical model. The invention returns to the technician the data necessary to quickly, accurately, and confidently adjust the shims at the balance rail and front rail to bring the keyboard keys into level.

Therefore, the key leveler, the computerized key leveling system that utilizes the key leveler, and the methods of leveling keys and determining key adjustments of the present invention solve the aforementioned drawbacks of the prior art devices and methods by: 1) being easy and quick to use; 2) having consistent results that are not so dependent on the technician's skill level and patience; 3) not being an iterative process in which adjustments to one key affect other keys which must be redone; 4) being accurate by telling the technician exactly what the washer and shim requirements are and without requiring any calculations; and 5) not being prone to over-adjustment of the keys by the technician.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A key leveler for leveling keys on keyboards of musical instruments, comprising:

a guide rail of sufficient length to extend over all of the keys on the keyboard;

a mounting device adapted to connect to the musical instrument to support said guide rail horizontally disposed above the keyboard;

a height indicator that indicates relative heights using a stylus slidably disposed through a mounting stem that terminates at a measuring tip;

a gauge holder assembly movably disposed along said guide rail to which said height indicator mounts with said stylus disposed in a vertically downward orientation to operably engage individual keys; and wherein said height indicator indicates relative key heights by manually positioning said stylus over individual keys by moving said gauge holder assembly along said guide rail based on movement of said tip of said stylus to determine necessary key adjustments.

2. The key leveler according to claim 1, wherein the mounting device comprises a pair of mounting clamps adapted to support opposite ends of the guide rail that are adjustable to grip musical instruments with various vertical gripping distances.

3. The key leveler according to claim 2, wherein each mounting clamp includes a pair of long and short arms each of generally L-shape having respective horizontal and vertical legs joined at respective elbows and that terminate at respective front and rear ends, said arms being pivotally interconnected midway along said vertical leg of said long arm and at said rear end of said short arm, a mounting handle comprised of a gripping handle affixed to a proximal end of a threaded shaft threadably engages and extends through a pivot block pivotally connected to said front end of said long arm, a distal end of said threaded shaft is pivotally connected to said elbow of said short arm such that rotating said mounting handle in opposite rotational directions causes said rear ends of said arms to move together to grip and move apart to release the musical instrument.

4. The key leveler according to claim 3, wherein a pivot pin is transversely affixed to the distal end of the threaded rod with opposite ends pivotally disposed in respective pivot holes of the elbow of the short arm.

5. The key leveler according to claim 3, wherein the long and short arms of the mounting clamps are respectively made of pairs of long and short arm plates each of L-shape held in a spaced relationship.

6. The key leveler according to claim 5, wherein the pairs of long and short arm plates of the long and short arms are held in the spaced relationship using at least one spacer tube retained to said arm plates using respective bolts and nuts.

7. The key leveler according to claim 3, wherein the pivot blocks includes a body with a threaded hole that threadably engages the shaft of the mounting handle and a pair of oppositely laterally extending pivot pins that pivotally engage respective pivot holes of the front end of the long arms.

8. The key leveler according to claim 5, wherein the mounting clamps are part of respective mounting clamp assemblies each of which includes a pair of mounting pads pivotally connected to the front ends of the arms adapted to engage and grip the musical instrument.

9. The key leveler according to claim 8, wherein each the mounting pad is pivotally connected to the arm using a bolt that extends through respective pivot holes of said mounting pad and said arm secured using a nut.

10. The key leveler according to claim 8, wherein each mounting pad comprises a body with a flat pad mounting surface and a resilient cushioning pad affixed thereto adapted to engage the musical instrument in a non-marring manner.

11. The key leveler according to claim 8, wherein each mounting clamp assembly includes an L-shaped clamp brace having respective horizontal and vertical arms adapted to be disposed between endmost of the keys engaging a key stop of the musical instrument to horizontally and vertically align and prevent slippage of said mounting clamps.

12. The key leveler according to claim 3, wherein the mounting clamps are part of respective rail mounting assemblies each of which includes a swing arm and a pair of adjustable length draw devices, said swing arms each having a lower section pivotally connected to the rear end of the long arm of one mounting clamp, a rear section to which the guide rail is mountable, and a front section disposed above said lower section interconnected by a middle section, each draw device having opposite ends respectively pivotally connected to the elbow of one of said long arms and to said front section of one of said swing arms such that adjusting lengths of said draw devices pivots said swing arms about a pivot axis through said rear ends of said long arms so said guide rail is positionable at a right angle to the keys of the musical instrument.

13. The key leveler according to claim 12, wherein each swing arm comprises a swing plate having the lower, front, middle, and rear sections, and a rail block affixed to said rear section to which the guide rail mounts.

14. The key leveler according to claim 13, wherein the rear section of each swing plate is of mating shape to the rail block, the bottom section has a bottom pivot hole to receive a bolt that extends through the rear ends of one of the long arms secured using a nut, and the front section has a front pivot hole to receive a bolt that extends into the end of one of the draw devices.

15. The key leveler according to claim 13, wherein each rail block has an upwardly open, vertical rail slot adapted to slidably receive the guide rail and a pair of threaded adjustment screw bores that respectively extend horizontally and vertically into said rail block to said rail slot each of which threadably receives a headed adjustment screw to vertically position said guide rail and to lock the guide rail to said rail block in a desired vertical position.

16. The key leveler according to claim 13, wherein the swing arms are left- and right-handed mirror images of one another in which the rail blocks are affixed inwardly of said swing plates.

17. The key leveler according to claim 12, wherein the ends of each draw device comprise a draw block and a pivot block interconnected by a headed draw screw, said draw block having an upper end with a non-threaded draw hole through which said draw screw extends and a lower end with a transverse pivot hole to pivotally connect to the elbow of one of the upper arms using a bolt secured by a nut, said pivot block having a threaded draw hole that threadably engages said draw screw and a transverse threaded pivot bore to pivotally connect to the front section of the swing arm using a bolt such that adjusting the length of said draw device is done by rotating said draw screw in a desired rotational direction.

18. The key leveler according to claim 17, wherein each draw screw includes a gripping head and a dependent shaft having a non-threaded proximal section that is closely rotatably received through the draw hole of the draw block and a threaded distal section that threadably engages the draw hole of the pivot block.

19. The key leveler according to claim 18, wherein the draw screw is retained to the draw block using an external snap ring that engages an external snap ring groove of the proximal section.

20. The key leveler according to claim 1, wherein the gauge holder assembly includes a bearing block that is slidably connected to the guide rail to which a gauge holder mounts adapted to retain the height indicator.

21. The key leveler according to claim 20, wherein the guide rail is of substantially constant cross-section comprising a rectangular body and a downwardly dependent mounting leg supported by the mounting device, and the bearing block is of substantially constant cross-section comprising a horizontally disposed top plate and a pair of integral retaining legs of L-shape that define an opened-bottom rail receiving channel that closely receives the guide rail.

22. The key leveler according to claim 21, wherein the top plate extends forwardly and rearwardly of the retaining legs with a pair of threaded front and rear holes that treadably engage the gauge holder in respective front and rear positions to check white and black keys of the musical instrument.

23. The key leveler according to claim 20, wherein the gauge holder includes a tubular gauge holder support comprised of a top section, a middle section adapted to removably mount to the bearing block, and a bottom section all through which a longitudinal bore extends that slidably receives the mounting stem of the height indicator at said top section and the stylus at said middle section, a retaining device adapted to removably retain said height indicator to said top section, and a push rod that closely slidably fits within said longitudinal bore extending downwardly past said gauge holder support having a top end surface that engages said tip of said measuring stylus and a convex bottom end surface that contacts the keys of the musical instrument.

24. The key leveler according to claim 23, wherein the longitudinal bore at the top section of the gauge holder support defines a stop shoulder to position the mounting stem of the height indicator.

25. The key leveler according to claim 24, wherein the middle section of the gauge holder support is externally threaded to matingly engage a threaded hole of the bearing block such that said gauge holder has respective threaded down and unthreaded positions for measuring the rest and depressed positions of white and black keys.

26. The key leveler according to claim 24, wherein a threaded thumbscrew bore extends transversely into the top section of the gauge holder support to the longitudinal bore and the retaining device comprises a thumbscrew having a gripping knob and a dependent threaded shaft that is matingly received in said thumbscrew bore with a locking tip that bears against the mounting stem to retain the height indicator to said gauge holder support.

27. The key leveler according to claim 23, wherein the push rod comprises an inner rod having the top end surface and a bottom end surface, and a coaxial extension tip having a top end surface that engages said bottom end surface of said inner rod and the bottom end surface.

28. The key leveler according to claim 27, wherein the inner rod and the extension tip are retained together by an externally threaded stud that extends longitudinally from the end surface of one of the inner rod and the extension tip that is threadably received in a threaded bore of another of said inner rod and said extension tip.

29. The key leveler according to claim 27, wherein the extension tip includes a rounded head having the bottom end surface and an upwardly dependent rod that is slidably received within the longitudinal bore.

30. The key leveler according to claim 23, wherein the push rod is upwardly spring-biased against the stylus of the height indicator to provide a compensating force that neutralizes a downward force exerted by said stylus and weight of said push rod to make contact with the keys without sufficient force to actuate the keys.

31. The key leveler according to claim 30, wherein the gauge holder includes a spring adapted to provide the compensating force to the push rod.

32. The key leveler according to claim 31, wherein the spring comprises a compression spring disposed within the longitudinal bore about said push rod, and the gauge holder includes a spring adjustment screw with a longitudinal bore through which said inner rod slidably coaxially extends adapted to adjustably engage said gauge holder support and bear against said spring to allow the compensating force to be adjusted.

33. The key leveler according to claim 32, wherein the spring adjustment screw includes a gripping head and an upwardly dependent threaded body adapted to operably threadably engage the gauge holder support and with a top surface that engages the spring.

34. The key leveler according to claim 23, wherein: 1) the gauge holder includes an index cylinder through which a longitudinal bore extends split by a bushing affixed therein into an upper portion in which the bottom section of the gauge holder support is slidably disposed and a lower portion, and a threaded set screw bore extends inwardly to said longitudinal bore that threadably receives a tipped set screw; 2) the push rod includes a head that closely slidably fits within said lower portion of said longitudinal bore with said bushing acting as an upper stop for said push rod and an upwardly dependent shaft that closely slidably extends through said bushing into said gauge holder support; and 3) the bottom section of said gauge holder support has a longitudinal slot intersected by respective rest and depressed position slots that extend in a radial direction partly around said bottom section, a tip of said set screw being slidably disposable within said slots to allow positioning said index cylinder in respective rest and depressed positions in which the bottom end surface of said push rod is at a proper height for the height gauge to measure the keys of the musical instrument in respective rest and depressed positions.

35. The key leveler according to claim 34, wherein the longitudinal slot of the gauge holder support is intersected by a park position slot to allow positioning said index cylinder in a parked position in which the bottom end surface of said push rod is clear of the keys of the musical instrument.

36. A key leveler for leveling keys on keyboards of musical instruments, comprising:

a guide rail of sufficient length to extend over all of the keys on the keyboard;

a pair of mounting clamps adapted to connect to the musical instrument to support opposite ends of said guide rail horizontally disposed above the keyboard and that are adjustable to grip musical instruments with various vertical gripping distances;

a height indicator that indicates relative heights using a stylus slidably disposed through a mounting stem that terminates at a measuring tip;

a gauge holder assembly that includes a bearing block slidably connected to said guide rail to which a tubular gauge holder mounts adapted to retain the height indicator with said stylus disposed in a vertically downward orientation to operably engage individual keys comprised of a top section, a middle section that is externally threaded to matingly engage a threaded hole of said bearing block such that said gauge holder has respective threaded down and unthreaded positions for measuring the rest and depressed positions of white and black keys, and a bottom section all through which a longitudinal bore extends that slidably receives said mounting stem of said height indicator at said top section and that slidably receives said stylus at said middle section with a threaded thumbscrew bore that extends transversely into said top section to said longitudinal bore, a thumbscrew having a gripping knob and a dependent threaded shaft that is matingly received in said thumbscrew bore with a locking tip that bears against said mounting stem to retain said height indicator to said gauge holder support, and a push rod that closely slidably fits within said longitudinal bore extending downwardly past said gauge holder support having a top end surface that engages said tip of said measuring stylus and a convex bottom end surface that contacts the keys of the musical instrument, said push rod being upwardly spring-biased against said stylus of said height indicator to provide a compensating force that neutralizes a downward force exerted by said stylus and weight of said inner rod to make contact with the keys without sufficient force to actuate the keys; and wherein said height indicator indicates relative key heights by manually positioning said stylus over individual keys by moving said gauge holder assembly along said guide rail based on movement of said tip of said stylus as moved by said push rod to determine necessary key adjustments.

37. The key leveler according to claim 36, wherein: 1) the gauge holder includes an index cylinder through which a longitudinal bore extends split by a bushing affixed therein into an upper portion in which the bottom section of the gauge holder support is slidably disposed and a lower portion, and a threaded set screw bore extends inwardly to said longitudinal bore that threadably receives a tipped set screw; 2) the push rod includes a head that closely slidably fits within said lower portion of said longitudinal bore with said bushing acting as an upper stop for said push rod and an upwardly dependent shaft that closely slidably extends through said bushing into said gauge holder support; and 3) the bottom section of said gauge holder support has a longitudinal slot intersected by respective park, rest, and depressed position slots that extend in a radial direction partly around said bottom section, a tip of said set screw being slidably disposable within said slots to allow positioning said index cylinder in respective park, rest, and depressed positions in which the bottom end surface of said push rod is at a proper height to allow positioning said index cylinder in a parked position in which the bottom end surface of said push rod is clear of the keys of the musical instrument, and for the height gauge to measure the keys of the musical instrument in respective rest and depressed positions.

38. The key leveler according to claim 37, wherein each mounting clamp includes a pair of long and short arms respectively made of pairs of long and short arm plates each of L-shape held in a spaced relationship having respective horizontal and vertical legs joined at respective elbows and that terminate at respective front and rear ends, said arms being pivotally interconnected midway along said vertical leg of said long arm and at said rear end of said short arm, a mounting handle comprised of a gripping handle affixed to a proximal end of a threaded shaft threadably engages and extends through a pivot block pivotally connected to said front end of said long arm, a distal end of said threaded shaft is pivotally connected to said elbow of said short arm such that rotating said mounting handle in opposite rotational directions causes said rear ends of said arms to move together to grip and move apart to release the musical instrument, said mounting clamps being part of respective mounting clamp assemblies each of which includes a pair of mounting pads pivotally connected to said front ends of the arms adapted to engage and grip the musical instrument.

39. The key leveler according to claim 38, wherein each mounting clamp assembly includes an L-shaped clamp brace having respective horizontal and vertical arms adapted to be disposed between endmost of the keys engaging a key stop of the musical instrument to horizontally and vertically align and prevent slippage of said mounting clamps.

40. The key leveler according to claim 37, wherein the mounting clamps are part of respective rail mounting assemblies each of which includes a swing arm and a pair of adjustable length draw devices, each swing arm comprising a swing plate having a lower section pivotally connected to the rear end of the long arm of one mounting clamp, a rear section to which the guide rail is mountable, and a front section disposed above said lower section interconnected by a middle section, and a rail block affixed to said rear section to which the guide rail mounts, each draw device having opposite ends respectively pivotally connected to the elbow of one of said long arms and to said front section of one of said swing arms such that adjusting lengths of said draw devices pivots said swing arms about a pivot axis through said rear ends of said long arms so said guide rail is positionable at a right angle to the keys of the musical instrument.

41. The key leveler according to claim 40, wherein the guide rail is of substantially constant cross-section comprising a rectangular body and a downwardly dependent mounting leg supported by the mounting device, the bearing block is of substantially constant cross-section comprising a horizontally disposed top plate and a pair of integral retaining legs of L-shape that define an opened-bottom rail receiving channel that closely receives said guide rail, said top plate having respective forward and rearward extensions that extend past said retaining legs with respective threaded front and rear holes that threadably engage the middle section of the gauge holder in respective front and rear positions to respectively check white and black keys of the musical instrument, and wherein each rail block has an upwardly open, vertical rail slot adapted to slidably receive said guide rail and a pair of threaded adjustment screw bores that respectively extend horizontally and vertically into said rail block to said rail slot each of which threadably receives a headed adjustment screw to vertically position said guide rail and to lock the guide rail to said rail block in a desired vertical position.

42. The key leveler according to claim 37, wherein the push rod comprises an inner rod having the top end surface and a bottom end surface, and a coaxial extension tip comprised of a rounded head having the bottom end surface and an upwardly dependent rod that is slidably received within the longitudinal bore of the index cylinder having a top end surface that engages said bottom end surface of said inner rod, said inner rod and said extension tip being retained together by an externally threaded stud that extends longitudinally from said end surface of one of said inner rod and said extension tip that is threadably received in a threaded bore of another of said inner rod and said extension tip.

43. The key leveler according to claim 37, wherein the gauge holder includes a compression spring vertically disposed about said push rod within the longitudinal bore of the index cylinder below the bushing adapted to provide the compensating force thereto, and a spring adjustment screw with a longitudinal bore through which said push rod slidably coaxially extends that is externally threaded to engage a mating internally threaded section of the longitudinal bore of the index cylinder to adjustably bear against said spring to allow the compensating force to be adjusted.

44. A computerized key leveling system for leveling keys on keyboards of musical instruments, comprising:

a key leveler that comprises; 1) a guide rail of sufficient length to extend over all of the keys on the keyboard; 2) a mounting device adapted to connect to the musical instrument to support said guide rail horizontally disposed above the keyboard; 3) an electronic height indicator that indicates relative heights as electronic output signals using a stylus slidably disposed through a mounting stem that terminates at a measuring tip; and 4) a gauge holder assembly movably disposed along said guide rail to which said height indicator mounts with said stylus disposed in a vertically downward orientation to operably engage individual keys; and wherein said height indicator indicates relative key heights by manually positioning said stylus over individual keys by moving said gauge holder assembly along said guide rail based on movement of said tip of said stylus to produce said output signals indicative of said relative key heights;

a computer that comprises a case that contains a microprocessor and related electronics adapted to receive said output signals from said key leveler, a display device, a keyboard includes a plurality of keys to allow manual entry user-defined input parameters and commands; and a software program that runs on said computer adapted to simultaneously calculate optimal shimming for all of the keys to level the keyboard based on said input parameters and said output signals and to produce at least one screen on said display device for viewing output data including said optimal shimming.

45. The key leveler according to claim 44, further comprising a position indicator device having a sensor mounted to the gauge holder and a plurality of position markers mounted to the guide rail, said position indicator device being adapted to produce electronic output signals indicative of which key the height indicator is measuring to the computer.

46. The key leveler according to claim 45, wherein the position indicator device utilizes a technology chosen from the group consisting of optical and magnetic.

47. A method of leveling keys on keyboards of musical instruments, comprising the steps of:

providing a musical instrument having a plurality of keys on a keyboard;

providing a key leveler that includes; 1) a guide rail of sufficient length to extend over all of the keys on the keyboard; 2) a mounting device adapted to connect to the musical instrument to support said guide rail horizontally disposed above the keyboard; 3) a height indicator that indicates relative heights using a stylus slidably disposed through a mounting stem that terminates at a measuring tip; and 4) a gauge holder assembly movably disposed along the guide rail to which the height indicator mounts with the stylus disposed in a vertically downward orientation to operably engage individual keys; and wherein the height indicator indicates relative key heights based on movement of the tip of the stylus;

mounting the key leveler to the musical instrument using the mounting device such that the stylus operably contacts the keys;

taking readings of relative key heights in rest positions from the height indicator by positioning the stylus over individual keys by moving the gauge holder assembly along the guide rail;

determining necessary key adjustments for the keys in the rest positions based on the relative key heights;

leveling the keyboard by adjusting rest position heights of at least some of the keys based on the necessary key adjustments; and dismounting the key leveler from the musical instrument by releasing the mounting device.

48. The method according to claim 47, wherein the step of taking readings includes individually placing the keys in a depressed position and taking additional readings of relative key heights, the step of determining necessary key adjustments is also done for the keys in the depressed positions, and the step of leveling the keyboard includes adjusting depressed key heights.

49. The method according to claim 47, wherein the step of determining necessary key adjustments is done with reference to a middle C key of the keyboard.

50. The method according to claim 47, wherein the step of mounting the key leveler includes vertically and pivotally adjusting the key leveler so the guide rail is parallel over the keyboard.

51. The method according to claim 47, wherein: 1) the musical instrument provided has a plurality of black keys of elevated height interspersed between a plurality of white keys; 2) the step of determining the necessary key adjustments is initially done with the height indicator disposed in a first position on the gauge holder assembly for measuring one of the white keys and the black keys; and 3) further comprising the step of repositioning the height indicator to a second position on the gauge holder assembly and repeating the steps of positioning the stylus, taking the readings, and determining the necessary key adjustments for another of the white keys and the black keys.

52. The method according to claim 51, wherein the step of leveling the keyboard is done for the white keys then for the black keys.

53. A method of leveling keys on keyboards of musical instruments, comprising the steps of:

providing a musical instrument having a plurality of black keys of elevated height interspersed between a plurality of white keys;

providing a key leveler that includes; 1) a guide rail of sufficient length to extend over all of the keys on the keyboard; 2) a mounting device adapted to connect to the musical instrument to support said guide rail horizontally disposed above the keyboard; 3) a height indicator that indicates relative heights using a stylus slidably disposed through a mounting stem that terminates at a measuring tip; 4) a gauge holder assembly movably disposed along the guide rail to which the height indicator mounts disposed in a first position for measuring one of the white keys and the black keys with the stylus disposed in a vertically downward orientation to operably engage individual keys; 5) and wherein the height indicator indicates relative key heights based on movement of the tip of the stylus;

mounting the key leveler to the musical instrument using the mounting device such that the stylus operably contacts the keys;

taking readings of relative key heights in rest positions from the height indicator and individually placing the keys in a depressed position and taking additional readings of relative key heights by positioning the stylus over individual keys by moving the gauge holder assembly along the guide rail;

determining necessary key adjustments for the one of the white keys and the black keys with reference to a middle C key of the keyboard in the rest and depressed positions based on the relative key heights;

repositioning the height indicator to a second position on the gauge holder assembly and repeating the steps of positioning the stylus, taking the readings, and determining the necessary key adjustments for another of the white keys and the black keys;

leveling the keyboard by adjusting rest and depressed position heights of at least some of the white keys then the black keys based on the necessary key adjustments; and dismounting the key leveler from the musical instrument by releasing the mounting device.

54. A method of determining key adjustments for leveling keys on keyboards of musical instruments, comprising the steps of:

providing a key leveling software program run on a computer;

entering dimensional data common to the keys that relate to the musical instrument's action into the computer accessible by the software program including: 1) theoretical key depression for the keys; 2) distance between front rail pins and balance rail pins for the keys; and 3) distance between balance rail pin and action arm for the keys;

entering desired key position information into the computer accessible by the software program of: 1) a desired key arc plane to compensate for more usage of center keys chosen from the group consisting of a straight plane, an arced plane, and an optimized plane; and 2) percent of keys acceptable to lower;

entering measured key height data into the computer accessible by the software program; and the software program uses the dimensional data of the keys and the desired key position information to: 1) calculate a theoretical height of the keys in the rest and depressed positions based on the desired key arc plane; 2) comparing to the measured key height data to produce a differential data set; 3) manipulating the differential data set, and the desired key arc plane for the optimized plane, based on the entered value of percent of keys acceptable to lower and a vertical misalignment routine to produce an optimized key position data set of least amounts of key adjustments at the balance and front rails; 4) using the optimized key position data set and the dimensional data to calculate a shim data set of how much shimming needs to be changed under each key at the balance and front rails to level the keys; and 5) outputting the shim data for each key for a technician to level all of the keys in the rest and depressed positions, and an optimal arc height for the optimized plane.

55. The method according to claim 54, wherein the software program allows running of what-if scenarios based on different desired arc heights of the theoretical arc to see effects of such adjustment in the results.

56. The method according to claim 54, further comprising the step of entering initial information into the computer accessible by the software program for reporting and calculation purposes chosen from the group consisting of 1) customer name; 2) customer address; 3) piano manufacturer; 4) piano age; 5) piano nickname; 6) today's date; 7) technician's name; 8) technician's company name; 9) technician's address; 10) technician's telephone number; and 11) units of measure in inches or millimeters.

57. The method according to claim 54, wherein the optimized plane is determined using a hierarchy of item importance of: 1) a least amount of disruption to the keys; 2) raising rather than lowering the keys; 3) manufacturing tolerances and angular misalignment where one edge of a key is higher than another; and 4) extreme data points are negated since these keys skew the raw data.

58. The method according to claim 54, wherein: 1) the musical instrument provided has a plurality of black keys of elevated height interspersed between a plurality of white keys; 2) the steps of entering the dimensional data, the desired key position information, and the measured key height data is done for both the white and the black keys; 3) the step of entering the desired key position information includes entering a theoretical additional height of the black keys above the white keys; and 4) the software program calculates the theoretical height of each black key by averaging the theoretical height of the white keys immediately on each side thereof and adding the theoretical additional height, and produces the differential data set, produces the optimized key position data set, calculates the shim data set, and outputs the shim data for both the white and black keys.

59. A method of determining key adjustments for leveling a plurality of black keys of elevated height interspersed between a plurality of white keys on keyboards of musical instruments, comprising the steps of:

providing a key leveling software program run on a computer;

entering initial information into the computer accessible by the software program for reporting and calculation purposes chosen from the group consisting of: 1) customer name; 2) customer address; 3) piano manufacturer; 4) piano age; 5) piano nickname; 6) today's date; 7) technician's name; 8) technician's company name; 9) technician's address; 10) technician's telephone number; and 11) units of measure in inches or millimeters;

entering dimensional data common to the white and black keys that relate to the musical instrument's action into the computer accessible by the software program including: 1) theoretical key depression for the keys; 2) distance between front rail pins and balance rail pins for the keys; and 3) distance between balance rail pin and action arm for the keys;

entering desired key position information for the white and black keys into the computer accessible by the software program of: 1) a desired key arc plane to compensate for more usage of center keys chosen from the group consisting of a straight plane, an arced plane, and an optimized plane; 2) percent of keys acceptable to lower; and 3) theoretical additional height of the black keys above the white keys;

entering measured key height data for the white and black keys into the computer accessible by the software program;

the software program uses the dimensional data of the white and black keys and the desired key position information to: 1) calculate a theoretical height of the white and black keys in the rest and depressed positions based on the desired key arc plane in which the theoretical height of each black key is calculated by averaging the theoretical height of the white keys immediately on each side thereof and adding the theoretical additional height; 2) comparing to the measured key height data to produce a differential data set; 3) manipulating the differential data set, and the desired key arc plane for the optimized plane, based on the entered value of percent of keys acceptable to lower and a vertical misalignment routine to produce an optimized key position data set of least amounts of key adjustments at the balance and front rails; 4) using the optimized key position data set and the dimensional data to calculate a shim data set of how much shimming needs to be changed under each key at the balance and front rails to level the keys; and 5) outputting the shim data for each key for a technician to level all of the keys in the rest and depressed positions, and an optimal arc height for the optimized plane; and wherein the software program allows running of what-if scenarios based on different desired arc heights of the theoretical arc to see effects of such adjustment in the results, and the optimized plane is determined using a hierarchy of item importance of: 1) a least amount of disruption to the keys; 2) raising rather than lowering the keys; 3) manufacturing tolerances and angular misalignment where one edge of a key is higher than another; and 4) extreme data points are negated since these keys skew the raw data.

* * * * *